US010626648B2

(12) United States Patent
Sakabe

(10) Patent No.: US 10,626,648 B2
(45) Date of Patent: Apr. 21, 2020

(54) SLIDING DOOR APPARATUS

(71) Applicant: NABTESCO CORPORATION, Tokyo (JP)

(72) Inventor: Daisuke Sakabe, Hyogo-ken (JP)

(73) Assignee: NABTESCO CORPORATION, Tokyo (JP)

( * ) Notice: Subject to any disclaimer, the term of this patent is extended or adjusted under 35 U.S.C. 154(b) by 178 days.

(21) Appl. No.: 15/573,796

(22) PCT Filed: May 12, 2016

(86) PCT No.: PCT/JP2016/064177
§ 371 (c)(1),
(2) Date: Nov. 13, 2017

(87) PCT Pub. No.: WO2016/182027
PCT Pub. Date: Nov. 17, 2016

(65) Prior Publication Data

US 2018/0148966 A1 May 31, 2018

(30) Foreign Application Priority Data

May 13, 2015 (JP) ..... 2015-098304
May 13, 2015 (JP) ..... 2015-098314

(51) Int. Cl.

| | |
|---|---|
| ***E05D 15/56*** | (2006.01) |
| ***E06B 3/46*** | (2006.01) |
| ***E05F 15/643*** | (2015.01) |
| ***E05D 15/06*** | (2006.01) |
| ***E05F 1/16*** | (2006.01) |
| *E06B 7/22* | (2006.01) |

(52) U.S. Cl.
CPC ..... *E05D 15/56* (2013.01); *E05D 15/0608* (2013.01); *E05D 15/565* (2013.01);
(Continued)

(58) Field of Classification Search
CPC .... E06B 3/4627; E06B 3/4645; E06B 3/4672; E05D 15/56; E05D 15/565
(Continued)

(56) References Cited

U.S. PATENT DOCUMENTS 2,297,655 A * 9/1942 Koch ..... E05F 5/02 267/129
3,276,166 A * 10/1966 Markus ..... E05D 15/1021 49/410
(Continued)

FOREIGN PATENT DOCUMENTS

CH 386279 A * 3/1962 ..... E05D 15/06
DE 2244900 A1 * 3/1973 ..... E05D 15/063
(Continued)

OTHER PUBLICATIONS

International Search Report issued by the Japanese Patent Office, dated Jul. 26, 2016, in International Application No. PCT/JP2016/064177; 2 pages.

*Primary Examiner* — Marcus Menezes
(74) *Attorney, Agent, or Firm* — Finnegan, Henderson, Farabow, Garrett & Dunner, LLP

(57) ABSTRACT

A sliding door apparatus capable of effectively restraining sliding movement of a door body is provided. A sliding door apparatus 1 includes: a rail 20 having an inner surface 24 formed to have a concave shape, the inner surface 24 having a first support surface 24A and a second support surface 24B which are not parallel to each other; a hanger 30A, 30B having a first driving member (32, 37) in rolling contact with the first support surface 24A, and a second driving member (33, 38) in rolling contact with the second support surface 24B; and a door body 40 configured to be moved in a longitudinal direction of the rail 20 through the hanger 30A, 30B. When seen along the longitudinal direction of the rail, the first support surface 24A and the second support surface
(Continued)

24B are formed to come close to each other as they extend toward a bottom of the inner surface 24.

14 Claims, 12 Drawing Sheets

(52) U.S. Cl.
CPC ..... *E05F 1/16* (2013.01); *E05F 15/643* (2015.01); *E06B 3/4627* (2013.01); *E06B 3/4636* (2013.01); *E06B 3/4645* (2013.01); *E06B 3/4672* (2013.01); *E05D 15/063* (2013.01); *E05D 15/0652* (2013.01); *E05Y 2201/474* (2013.01); *E05Y 2201/638* (2013.01); *E05Y 2201/684* (2013.01); *E05Y 2201/69* (2013.01); *E05Y 2900/132* (2013.01); *E06B 3/469* (2013.01); *E06B 7/22* (2013.01)

(58) Field of Classification Search
USPC ..... 49/209, 210, 221, 225
See application file for complete search history.

(56) References Cited

U.S. PATENT DOCUMENTS 3,611,637 A * 10/1971 Saino ..... E05D 15/1021 49/235
4,096,664 A * 6/1978 Perry ..... E05D 15/565 312/229
4,651,469 A * 3/1987 Ngian ..... E05D 15/1021 16/87 R
4,680,828 A * 7/1987 Cook ..... E05D 15/0634 16/102
5,165,142 A * 11/1992 Pilsbury ..... B66B 13/301 16/90
5,301,468 A * 4/1994 Kamezaki ..... E05D 15/1021 49/225
5,468,032 A * 11/1995 Hebert ..... E05C 17/54 16/82
6,745,813 B2 * 6/2004 Yorgason ..... E05D 15/063 16/87 R
7,610,718 B2 * 11/2009 Kopish ..... E05D 15/1042 49/209
9,290,977 B2 * 3/2016 Haab ..... E05D 15/0652

FOREIGN PATENT DOCUMENTS

| | | | | |
|---|---|---|---|---|
| EP | 1 043 510 A2 | | 10/2000 | |
| FR | 2582343 A1 | * | 5/1985 | ..... E05D 15/06 |
| FR | 2709323 A1 | * | 8/1993 | ..... E06B 3/46 |
| GB | 1019097 A | * | 1/1964 | ..... E05D 13/02 |
| JP | 60-48578 | | 4/1985 | |
| JP | 62-69579 | | 5/1987 | |
| JP | 2537064 | | 5/1997 | |
| JP | 2000-320228 | | 11/2000 | |
| JP | 2000-320288 | | 11/2000 | |

* cited by examiner

SLIDING DOOR APPARATUS

FIELD OF THE INVENTION

The present invention relates to a sliding door apparatus.

BACKGROUND ART

Some sliding door apparatuses have a structure in which a door body that slides with respect to an opening part is moved in a depth direction immediately before the door body closes the opening part. Such sliding door apparatuses can improve interior airtightness.

For example, JP62-069579U discloses a door apparatus including a rail horizontally extended in such a manner that the rail is inclined at an angle of 45 degrees, a hanger having a door roller mechanism with a pair of rollers, and a door body hanging from the rail by means of the hanger. In this door apparatus, one roller of the pair of rollers is supported on an upper end surface of the rail, while the other roller of the pair of rollers is supported on an inclined side surface of the rail. A recess is formed in a part of the upper end surface of the rail. Thus, immediately before the door body closes the opening part, the roller on the upper end surface of the rail falls down the recess, so that the door body is moved downward and in the depth direction. Thus, the door body comes close to the opening part.

In addition, for example, JP2537064Z discloses a door apparatus including a horizontally extended rail, a hanger having a roller that rolls on the rail, and a door body hanging from the rail by a hanger. In this door apparatus, a recess, which is concaved downward and toward an opening part, is formed in a part of the rail. Thus, immediately before the door body closes the opening part, the roller on the rail falls down the recess, so that the door body is moved downward and in the depth direction. Thus, the door body comes close to the opening part.

In a door apparatus of this type, when the door body is opened, it is necessary to cause the roller fitted in the recess to roll on an inclined part of the recess so as to escape from the recess. This operation requires considerable force. Thus, the door apparatus of Patent Document 1 is equipped with an assisting mechanism that assists the opening operation by making use of an elastic force of a coil spring that is compressed as the door body comes close to the closed state.

SUMMARY OF THE INVENTION

In the door apparatus of JP62-069579U, one roller is supported on the upper end surface of the rail, while the other roller is supported on the inclined side surface of the rail. In this structure, when the door body is swung about an axis parallel to the longitudinal direction of the rail, the respective rollers receives from the corresponding support surfaces reaction forces in a direction in which the swinging movement is restrained. Thus, the swinging movement of the door body is restrained.

However, the roller supported on the upper end surface is configured to fall down the recess in order to move the door body. Thus, since the roller suddenly falls down the recess, the roller cannot constantly receive a reaction force acting in a direction in which the swinging movement is restrained, it cannot be said that the support state of the roller by the rail is always good. Thus, there is a room for improvement to further effectively restrain the swinging movement of the door body by making the support state more stable.

In addition, in the door apparatus of JP62-069579U, since the pair of rollers are located in a V-shape, an area occupied by the rollers in the depth direction is relatively large. Thus, there also leaves room for improvement for reducing an area occupied by the rollers.

In particular, when a door body having a heavy weight is used, it is necessary for a roller to have a larger diameter. When this need arises, dimensions of the roller increase in the depth direction and in a vertical direction. In this case, when a case, which accommodates rollers and a drive unit above an opening part, has restriction in design or in size, it is difficult that the case accommodates the roller of a large diameter, and it might be impossible to install a door apparatus. In order to avoid this situation, restraint in area occupied by a roller is desired.

The present invention has been made in view of the above circumstances. The object of the present invention is to provide a sliding door apparatus capable of effectively restraining swinging movement of a door body.

The present invention is a sliding door apparatus comprising: a rail having an inner surface formed to have a concave shape, the inner surface having a first support surface and a second support surface which are not parallel to each other; a hanger having a first driving member in rolling contact with the first support surface, and a second driving member in rolling contact with the second support surface; and a door body configured to be moved in a longitudinal direction of the rail through the hanger; wherein when seen along the longitudinal direction of the rail, the first support surface and the second support surface are formed to come close to each other as they extend toward a bottom of the inner surface.

Due to the sliding door apparatus according to the present invention, when the door body is swung about an axis line parallel to the longitudinal direction of the rail, the first driving member and the second driving member receive from the corresponding support surfaces reaction forces acting in a direction in which the swinging movement is restrained. In addition, the concaved inner surface of the rail surrounds the first driving member and the second driving member such that their movement outside the rail (such as derailing) is restricted. Thus, the support state of the first driving member and the second driving member by the rail is made stable. Thus, the door body is smoothly moved, while the swinging movement of the door body can be effectively restrained. Moreover, since the first and the second driving members can roll separately from each other on the corresponding support surfaces, uneven abrasion of the first and the second driving members can be prevented.

The rail may be located to extend along an outer circumferential edge part of an opening part that is opened and closed by the door body. When seen along the longitudinal direction of the rail, the first support surface may be located closer to the opening part than the second support surface. The first support surface may include a flat part and an inclined part inclined from the flat part toward the opening part.

Due to this structure, the door body can be moved in the longitudinal direction of the rail and can also be moved toward the opening part, whereby a door structure in which the door body comes close to the opening part can be provided. In a case where the door body is moved toward the opening part by the inclined part of the rail, when a roller moves on the inclined part, the roller cannot constantly receive from the inclined part a reaction force acting in the direction in which the swinging movement is restrained, whereby the door body is likely to swing. Particularly in this case, in the sliding door apparatus according to the present invention, since the support state of the first driving member and the second driving member by the rail can be made stable by the concaved inner surface of the rail, the swinging movement of the door body can be effectively restrained. In addition, even when the door body is moved by the inclined part of the rail toward the opening part, since the first and the second driving members can roll separately from each other on the corresponding support surfaces, uneven abrasion of the first and the second rollers can effectively be prevented.

In addition, the inclined part may have a first inclined area and a second inclined area, which have inclination angles different from each other.

According to such a structure, when the driving member rolls on the inclined part, it is possible to vary resistances from the door body between the first inclined area and the second inclined area. Thus, an operation feeling of the door body can be suitably varied.

In addition, the rail may have a close-side rail part located on the side of the outer circumferential edge part of the opening part, and an open-side rail part located at a position farther from the outer circumferential edge part of the opening part than the close-side rail part. The flat part and the inclined part may be formed on each of the first support surface in the close-side rail part and the first support surface in the open-side rail part. The hanger may have a first hanger and a second hanger located side by side from the side of the close-side rail part to the side of the open-side rail part. The first hanger may have the two first driving members and the one second driving member located between the two first driving members. The second hanger may have the two second driving members and the one first driving member located between the two second driving members. A distance between an inclination start point of the inclined part of the open-side rail part and an end of the close-side rail part on the side adjacent to the open-side rail part may be not more than a distance between the two first driving members in the first hanger.

Due to this structure, when the door body is moved from the close-side rail part toward the open-side rail part, the first driving member of the first hanger can be transferred to the open-side rail part across the inclined part of the open-side rail part, without being guided toward the opening part by the inclined part of the open-side rail part. Thus, the door body can be moved away from the opening part as soon as possible without any trouble in movement, whereby a non-pulled part of the door body can be prevented.

In addition, the sliding door apparatus, the first driving member and the second driving member are preferably located to be offset from each other in the longitudinal direction of the rail.

Due to this structure, when seen along the longitudinal direction of the rail, in other words, in a plane of projection projected in the longitudinal direction of the rail, the first driving member and the second driving member can be located such that the first driving member and the second driving member are partly overlapped with each other. Thus, an area occupied by the first driving member and the second driving member can be restrained.

To be specific, when the first driving member and the second driving member are located to be partly overlapped with each other in the plane of a projection projected in the longitudinal direction of the rail, an area occupied by the first driving member and the second driving member can be restrained in the depth direction and in the vertical direction, as compared with a case in which the first driving member and the second driving member are located not to be overlapped with each other. Thus, for example, the door apparatus can be made smaller as a whole.

In addition, for example, when a door body having a large weight is used so that the first driving member and the second driving member have to be made larger, the dimensions of the first driving member and the second driving member in the depth direction and in the vertical direction can be restrained. Thus, even when a case, which accommodates the first driving member, the second driving member and the drive unit on the side of the outer circumferential edge part of the opening part that is opened and closed by the door body, has restriction in design or in size, the enlarged first driving member and the second driving member can be highly possibly accommodated in the case. Thus, it can be avoided that the door apparatus cannot be installed because of the enlargement of the rolling members.

In addition, the first driving member and the second driving member may be rollers. When seen along the longitudinal direction of the rail, a rotation axis of the first driving member may be orthogonal to a normal line of the first support surface, and a rotation axis line of the second driving member may be orthogonal to a normal line of the second support surface. The first driving member and the second driving member may be located to be shifted from each other in the longitudinal direction of the rail, and are partly overlapped with each other in a plane of a projection projected in the longitudinal direction of the rail.

Due to this structure, when rollers are employed as the first driving members and the second driving members, the dimensions of the rollers in the depth direction and in the vertical direction can be effectively restrained.

In the sliding door apparatus, the hanger may have the two first driving members and the one second driving member, with the second driving member being located between the two first driving members, or may have the two second driving members and the one first driving member, with the first driving member being located between the two second driving members.

Due to this structure, when the door body is likely to be rotated about an axis line orthogonal to the longitudinal direction of the rail, which is the axis line passing through between the first support surface and the second support surface when seen along the longitudinal direction of the rail, the driving members located on the end side of the hanger prevent the rotation. Thus, operability of the connecting operation between the door body and the hanger can be improved.

By the way, the coil spring used in the door apparatus of JP2537064Z has a larger compression amount, as the door body comes close to the close position. When the door body reaches the close position, an elastic force of the coil spring becomes maximum. When an operation for opening the door body is activated, the maximum elastic force accumulated in the coil spring assists the movement of the door body.

However, as the door body is moved in the open direction, the elastic force of the coil spring decreases. In addition, an inclined part of the recess on which the roller rolls for escaping from the recess has a constant angle. Thus, in a state where the roller is situated in the recess, the roller receives a resistance which increases as the opening operation proceeds. Thus, there is a room for improvement in smoothly opening the door body.

Thus, the sliding door apparatus according to the present invention may further comprise: an operation assisting rod including a fixed member fixed on the door body, a rod body held by the fixed member and movable in a direction parallel to the longitudinal direction of the rail, and an elastic member located between the fixed member and the rod body; a receiving member located on a line extended in a direction of an axis line from a distal end of the rod body, the receiving member being configured to bear against the distal end of the rod body and to elastically deform the elastic member to push the rod body toward the fixed member, during the movement of the operation assisting rod caused by the movement of the door body toward the close position. When the door body is moved toward the close position, the door body then may be moved from the flat part of the first support surface toward the inclined part. When the first driving member of the hanger reaches an end of the flat part of the first support surface on the side of the inclined part, or reaches the inclined part of the first support surface, the distal end of the rod body and the receiving member then may be configured to bear against each other. The inclined part then may have a plurality of inclined areas of different inclination angles.

Due to this structure, when the door body in the close position is opened, the resistance from the door body can be adjusted by the plurality of inclined areas respectively, while making use of the elastic force of the elastic member. Thus, by adjusting the elastic force for each of the inclined areas, the door body in the close position can be smoothly lifted to open by a small force, and a tight contact between the packing (outer circumferential edge part of the opening part) and the door body can be promptly smoothed. Therefore, the door body, which has been moved toward the opening part upon movement to the close position, can be smoothly opened.

In this case, to be specific, for example, in the plurality of inclined areas, an inclined area, in which the elastic member has a larger elastic force when the first driving member reaches there, may be set to have a larger inclination angle.

Due to this structure, the inclined area, which can ensure relatively a larger elastic force acting on the door body, is set to have relatively a larger inclination angle. Thus, when the door body is moved on the inclined area toward the open position, the movement of the door body is assisted by a large elastic force, although a larger resistance from the door body is produced. On the other hand, the inclined area, which cannot ensure relatively a larger elastic force acting on the door body, is set to have relatively a smaller inclination angle. Thus, when the door body is moved toward the open position on the inclined area, a resistance from the door body becomes smaller, although the elastic force is small. Thus, non-uniform resistance is restrained from occurring in the door body. Therefore, the door body, which has been moved toward the opening part upon movement to the close position, can be smoothly opened.

In addition, the elastic force of the elastic member may increase in proportion to an elastic deformation volume. In the plurality of inclined areas, an inclination angle of an inclined area located on the side of the close position of the door body may be larger than an inclination angle of an inclined area located closer to the open position of the door body than the inclined area.

In addition, in the sliding door apparatus, the operation assisting rod may have an adjusting mechanism part configured to hold relative positions between the fixed member and the rod body at given positions, with the elastic member being elastically deformed.

Due to this structure, by holding the relative positions between the fixed member and the rod body at given positions by the adjusting mechanism part with the elastic member being elastically deformed, the elastic force of the elastic member before the rod body and the receiving member bear against each other can be adjusted. Thus, for example, when the door body is exchanged to a door body having a different weight, the elastic force of the elastic member can be adjusted depending on the difference in weight. Thus, difference in feeling of the operation for opening the door body before and after the weigh varies can be restrained. As a result, after the weight has varied, the door body can be smoothly opened.

In addition, in the sliding door apparatus, the elastic member may include a plurality of coil springs located on a side of an outer peripheral of the rod body, and a connection member configured to connect facing ends of the adjacent coil springs, the connection member being slidably supported on the rod body.

Due to this structure, a deflection amount of each coil spring is restrained. It can be restrained that the coil spring and the rod body come into contact to each other to generate noises.

In addition, in this case, a cylindrical body slidably supported on the rod body may be located between the coil spring and the rod body.

Due to this structure, the cylindrical body restrains the deflection of the coil spring, and prevents the contact between the coil spring and the rod body whereby generation of noises can be effectively restrained.

In addition, in the sliding door apparatus, a ball may be rotatably held on the distal end of the rod body, the ball being configured to bear against the receiving member.

Due to this structure, when the rolling member rolls on the inclined part so that the door body is moved toward the opening part, the distal end of the rod body rolls on the receiving member through the ball. Thus, sliding resistance between the distal end of the rod body and the receiving member can be restrained.

Due to the sliding door apparatus according to the present invention, the swinging movement of the door body can be effectively restrained.

DESCRIPTION OF EMBODIMENTS

Herebelow, an embodiment of the present invention is described with reference to the drawings.

Figure 1:
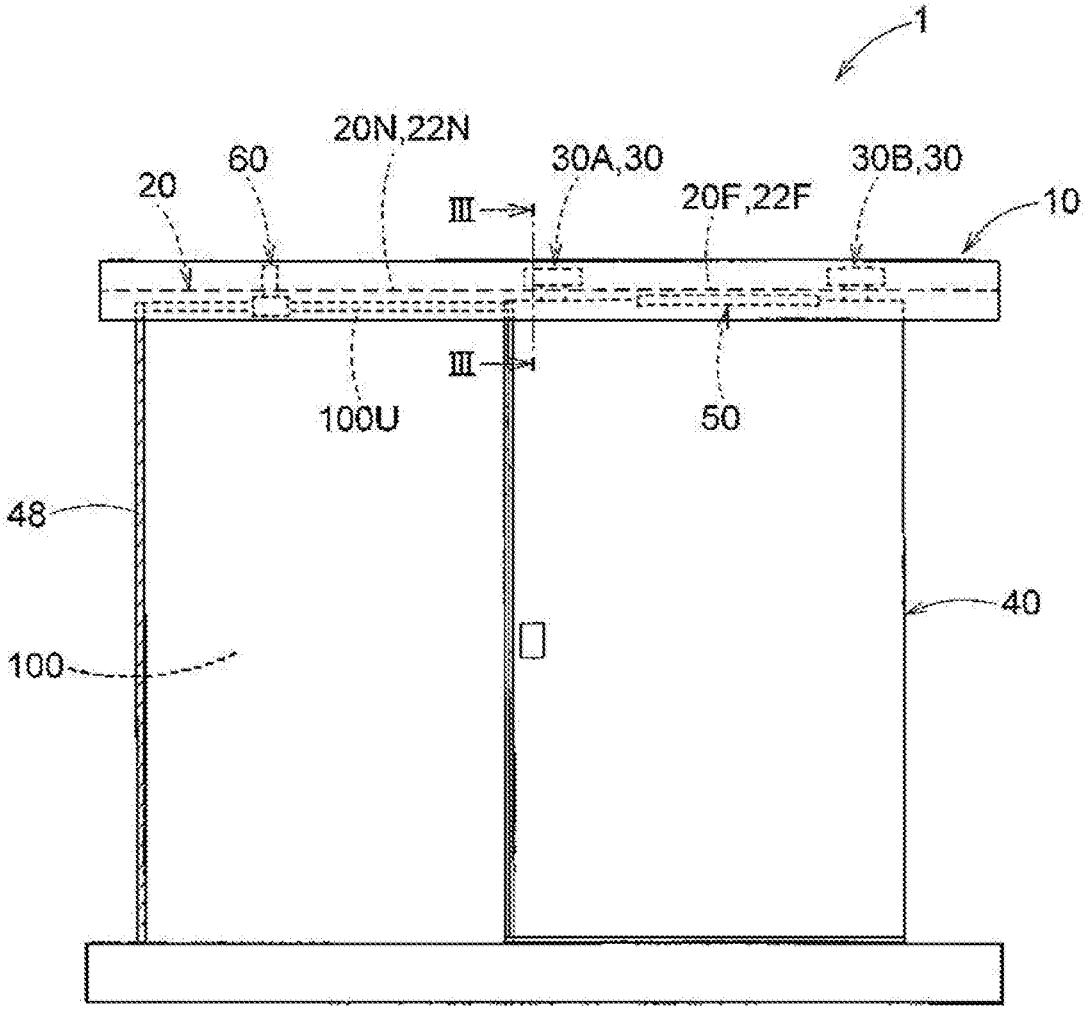
FIG. 1 is a front view of a sliding door apparatus according to one embodiment of the present invention, which is in an open position.
Figure 2:
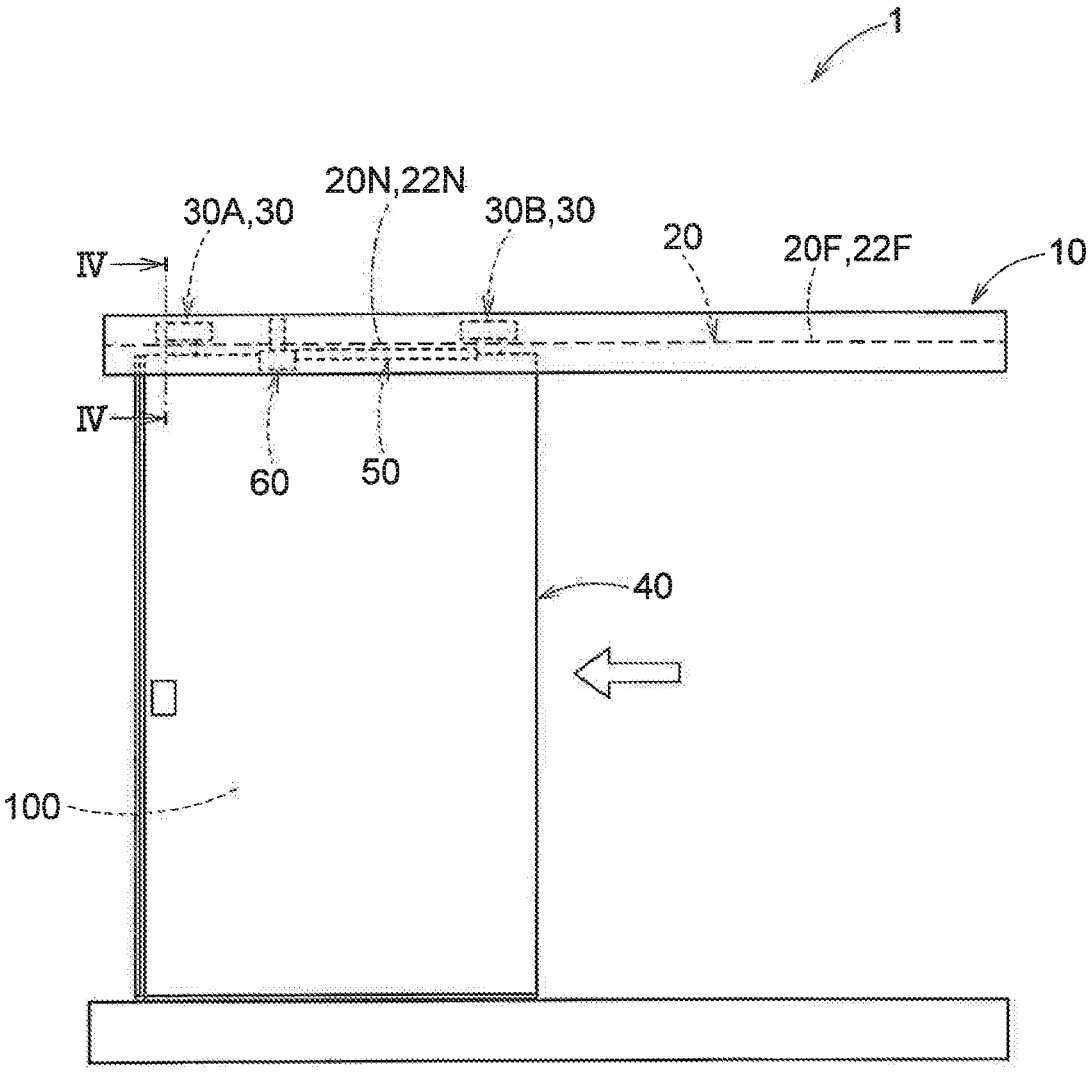
FIG. 2 is a front view of the sliding door apparatus shown in FIG. 1, which is in a close position.
Figure 3A:
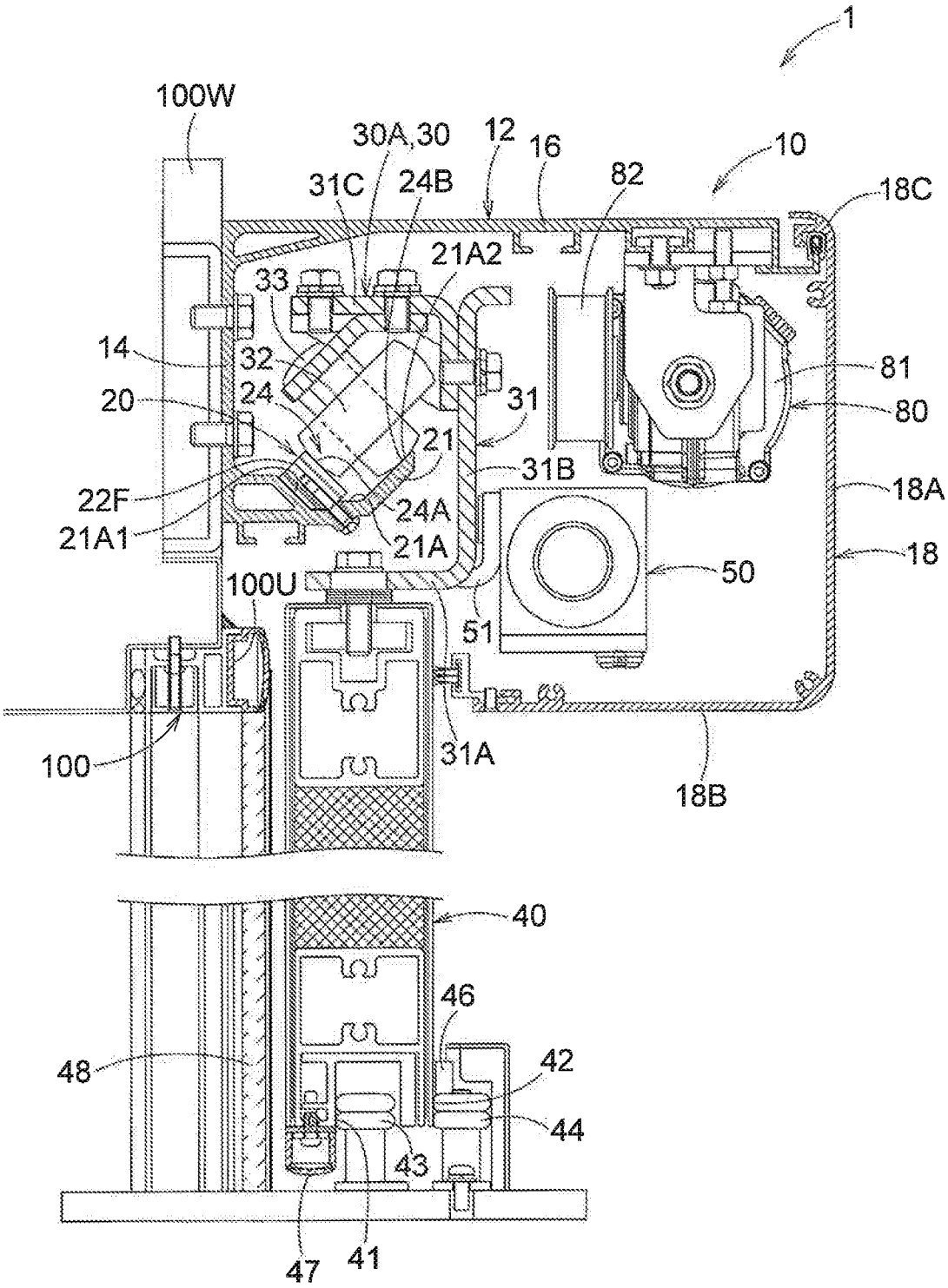
FIG. 3A is a sectional view of the sliding door apparatus along the III-III line in FIG. 1.
Figure 3B:
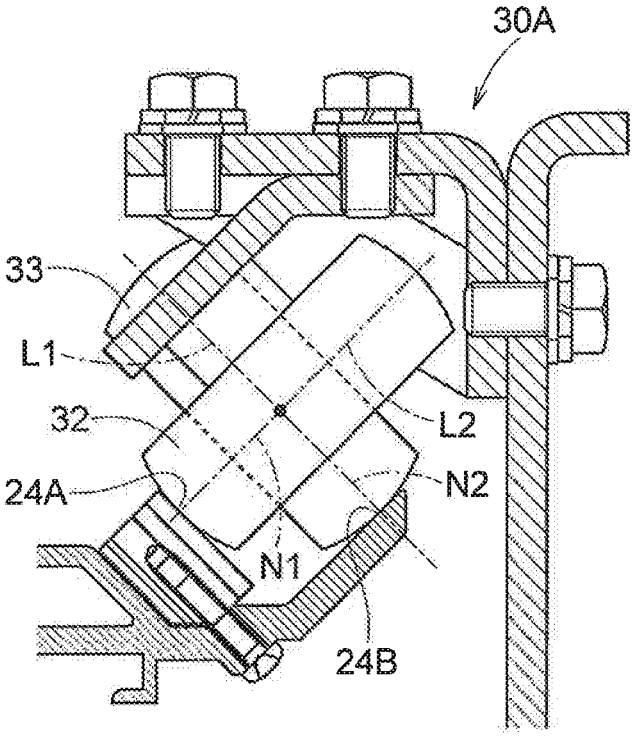
FIG. 3B is an enlarged view showing a main part of FIG. 3A.
Figure 4:
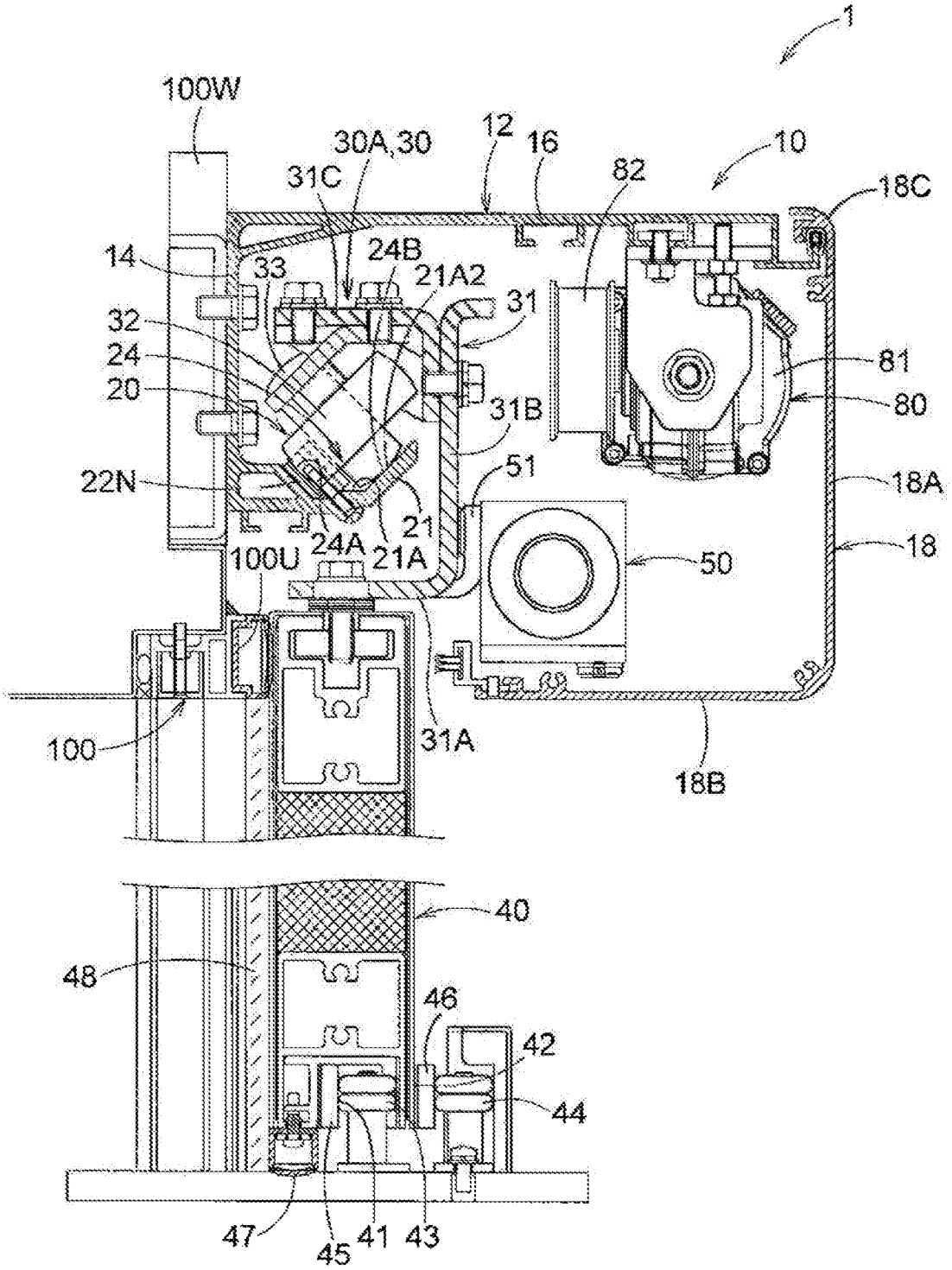
FIG. 4 is a sectional view of the sliding door apparatus along the IV-IV line in FIG. 2.

FIG. 1 shows a front view of a sliding door apparatus 1 according to the embodiment, which is in an open position (full open position). FIG. 2 shows a front view of the sliding door apparatus 1 which is in a close position. FIG. 3A shows a sectional view along the III-III line in FIG. 1. FIG. 3B shows an enlarged view of a main part of FIG. 3A. FIG. 4 shows a sectional view along the IV-IV line in FIG. 2.

As shown in FIG. 1 through FIG. 4, the sliding door apparatus 1 includes an upper case 10 having a rail 20 that is located to horizontally extend along an upper edge part 100U of an outer circumferential edge part of an opening part 100 of a rectangular shape, a hanger 30 having a roller that is a driving member in rolling contact with support surfaces 24A and 24B formed on the rail 20, a door body 40 that is hung on the rail 20 by the hanger 30 so as to be moved in a longitudinal direction of the rail 20, an operation assisting rod 50 configured to assist an opening operation of the door 40 by making use of an elastic force of an elastic member 54 (see FIG. 11) described below; and a receiving member 60 configured to bear against the operation assisting rod 50 so as to elastically deform the elastic member 54, when the door body 40 is moved toward the close position.

As shown in FIG. 3A and FIG. 4, the upper case includes a case body 12 fixed on a wall part 100W above the upper edge part 1000 such that the case body 12 is extended along the upper edge part 1000 of the opening part 100, and a cover body 18 that covers the case body 12 from ahead. In this embodiment, the aforementioned rail 20 is integrally formed with the case body 12. The case body 12 integrally has a base part 14 fixed on the wall part 100W, the aforementioned rail 20 extended forward from a lower end of the base part 14, and a roof part 16 extended forward from an upper end of the base part 14.

The base part 14 has a plate-like shape and is horizontally extended lengthwise. The base part 14 is fixed onto the wall part 100W by fastening members such as bolts. Similarly thereto, the rail 20 and the roof part 16 horizontally extend lengthwise. The roof part 16 is extended longer than the rail 20 to the front.

As shown in FIG. 1 and FIG. 2, the receiving member 60 is fixed on a portion of a lower surface of the roof part 16, the portion being located above the opening part 100. As shown in FIG. 3A and FIG. 4, a drive unit 80 is fixed on the lower surface of the roof part 16. The drive unit 80 includes a motor 81, and a drive pulley 82 configured to be driven in rotation by the motor 80. A belt (illustration omitted) is wound around the drive pulley 82. The belt is also wound around a driven pulley located at a position distant from the drive pulley 82 in the longitudinal direction of the rail 20. At least one of the aforementioned hangers 30 is connected to the aforementioned belt through a bracket (illustration omitted).

The cover body 18 is horizontally extended lengthwise, and has a front plate part 18A and a bottom plate part 18B. In a vertically sectioned view, the front plate part 18A and the bottom plate part 18B are joined in an L-shape. The front plate 18A covers the case body 12 from ahead in such a manner that the front plate 18A faces the base part 14. The bottom plate part 18B is extended rearward from a lower end of the front plate part 18A so as to face the roof part 16.

The cover body 18 has a hook part 18C formed on an upper end of the front plate part 18A. By engaging the hook part 18C with a front end of the roof part 16, the cover body 18 is mounted on the case body 12. When the cover body 18 is mounted on the case body 12, the drive unit 80 and the operation assisting rod 50, etc., are covered with the cover body 18 from ahead and below.

In the sliding door apparatus 1, when the drive unit 80 drives to rotate the drive pulley 82 in one direction, the hanger 30 is moved toward the opening part 100 from the open position shown in FIG. 1, so that the door body 40 is moved toward the opening part 100. Thus, as shown in FIG. 2, the sliding door apparatus 1 takes the close position in which the door body 40 closes the opening part 100. On the other hand, when the drive unit 80 drives to rotate the drive pulley 82 in the other direction opposed to the one direction, the hanger 30 is moved away from the opening part 100 from the position shown in FIG. 2, so that the door body 40 is moved away from the opening part 100. Thus, as shown in FIG. 1, the sliding door apparatus 1 takes the open position in which the door body 40 opens the opening part 100. Namely, the sliding door apparatus 1 in this embodiment is constituted as a single sliding door apparatus capable of switching between the close position in which the one door body 40 is moved to one side of the longitudinal direction of the rail 20 to cover the opening part 100 as a whole, and the open position in which the door body 40 is moved to the other side of the longitudinal direction to open the opening part 100.

Figure 5:
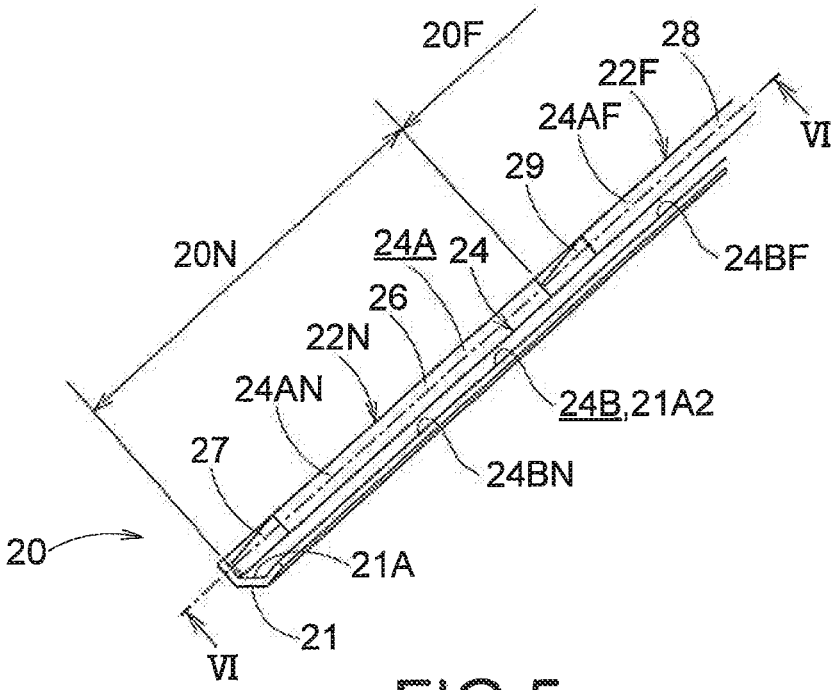
FIG. 5 is a perspective view of a rail of the sliding door apparatus shown in FIG. 1.

FIG. 5 shows a perspective view of the rail 20. As shown in FIG. 3A, FIG. 4 and FIG. 5, in this embodiment, when seen along the longitudinal direction of the rail 20 (in the vertically sectioned view shown in FIG. 3A), the rail 20 has a rail base part 21 in which a concave groove part 21A concaved downward is formed, as well as a close-side rail forming member 22A and an open-side rail forming member 22F which are fixed in the groove part 21A of the rail base part 21.

The rail base part 21 and the groove part 21A formed therein are horizontally extended lengthwise. The groove part 21A includes a first inclined surface 21A1 inclined forward and downward from the side of the base part 14 (wall part 100W), and a second inclined surface 21A2 inclined forward and upward from the side of the first inclined surface 21A1. The close-side rail forming member 22N and the open-side rail forming member 22F are fixed to the first inclined surface 21A1. In this embodiment, the close-side rail forming member 22N and the open-side rail forming member 22F are removably fixed to the first inclined surface 21A1 by a fastening member such as a bolt.

As shown in FIG. 1 and FIG. 2, in a front view, the close-side rail forming member 22N is located on the side of the upper edge part 100U (directly above the upper edge part 100U) of the opening part 100, and the open-side rail forming member 22F is located at a position horizontally distant from the upper edge part 100U. The close-side rail forming member 22N and the open-side rail forming member 22F are linearly located side by side on the first inclined surface 21A1. Here, a concave inner surface 24 concaved downward is formed in the rail 20 by the surfaces of these close-side rail forming member 22N and the open-side rail forming member 22F, and a surface of the second inclined surface 21A2 of the groove part 21A of the rail base part 21.

A first support surface 24A and a second support surface 24B, which are not parallel to each other, are formed on the inner surface 24. The first support surface 24A is formed by the surfaces of the close-side rail forming member 22N and the open-side rail forming member 22F, and the second support surface 24B is formed by the surface of the second inclined surface 21A2. When seen along the longitudinal direction of the rail 20, the first support surface 24A and the second support surface 24B are formed to come close to each other, as they extend to a bottom side of the inner surface 24, i.e., downward.

In this embodiment, when seen along the longitudinal direction of the rail 20, the first support surface 24A is located closer to the opening part 100 than the second support surface 24B in the back and forth direction (depth direction). The first support surface 24A is formed to extend at an angle of 45 degrees with respect to a horizontal plane from the side of the base part 14 (wall part 100W) to incline forward and downward. The second support surface 24B is formed to extend at an angle of 45 degrees with respect to a horizontal plane from the side of the first support surface 24A to incline forward and upward.

The rail 20 is described in more detail. As shown in FIG. 5, in this embodiment, the rail 20 is divided into a close-side rail part 20N and an open-side rail part 20F at a boundary between the close-side rail forming member 22N and the open-side rail forming member 22F in the longitudinal direction of the rail. In other words, the rail 20 includes the close-side rail part 20N which is located on the side of the upper edge part 100U (directly above the upper edge part 100U) of the opening part 100, and the open-side rail part 20F which is located at a position horizontally distant from the upper edge part 100U.

Thus, the first support surface 24A is divided into a close-side first support surface 24AN formed by the surface of the close-side rail forming member 22N, and an open-side first support surface 24AF formed by the open-side rail forming member 22F. In addition, the second support surface 24B is divided into a close-side second support surface 24BN formed by a part of the second inclined surface 21A2 of the groove part 21A, which part is opposed to the close-side rail forming member 22N, and an open-side second support surface 24BF formed by a part of the second inclined surface 21A2 of the groove part 21A, which part is opposed to the open-side rail forming member 22F.

Figure 6:
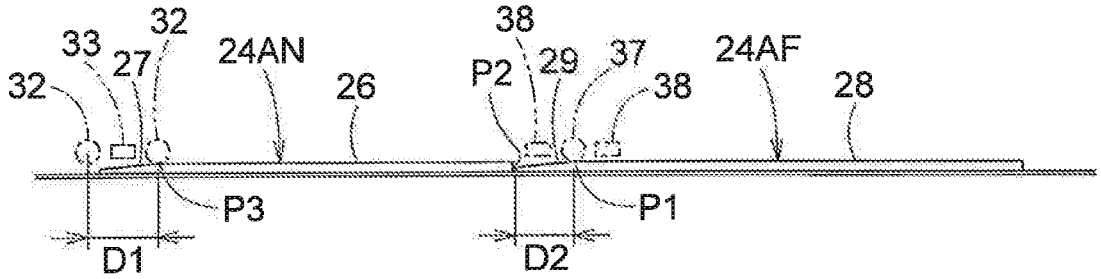
FIG. 6 is a sectional view along the VI-VI line in FIG. 5.

FIG. 6 shows a sectional view along the VT-VT line of FIG. 5, showing the shapes of the close-side first support surface 24AN and the open-side first support surface 24AF. As shown in FIG. 5 and FIG. 6, the close-side first support surface 24AN includes a flat part 26 that is extended parallel to the longitudinal direction of the rail 20, and an inclined part 27 that is inclined downward and toward the opening part 100 (rearward). The inclined part 27 is formed on an end of the close-side first support surface 24AN, which end is directed in a direction in which the door body 40 is moved toward the close position. On the other hand, the close-side second support surface 24BN is generally formed by a flat surface that is extended parallel to the longitudinal direction of the rail 20.

Similarly, the open-side first support surface 24AF includes a flat part 28 that is extended parallel to the longitudinal direction of the rail 20, and an inclined part 29 that is inclined downward and toward the opening part 100 (rearward). The inclined part 29 is formed on an end of the open-side first support surface 24AF, which end is directed in the direction in which the door body 40 is moved toward the close position, i.e., on the end adjacent to the close-side first support surface 24AN. On the other hand, the open-side second support surface 24BF is generally formed by a flat surface that is extended parallel to the longitudinal direction of the rail 20.

The aforementioned inclined parts 27 and 29 are formed in order to guide the hanger 30 from the flat parts 26 and 28 of the rail 20 downward and toward the opening part 100 so that the door body 40 is moved downward and toward the opening part 100 immediately below the close position. The flat parts 26 and 28 are formed coplanar with each other, and the inclined parts 27 and 29 are formed to have the same longitudinal length and the same inclined shape each other.

Figure 7:
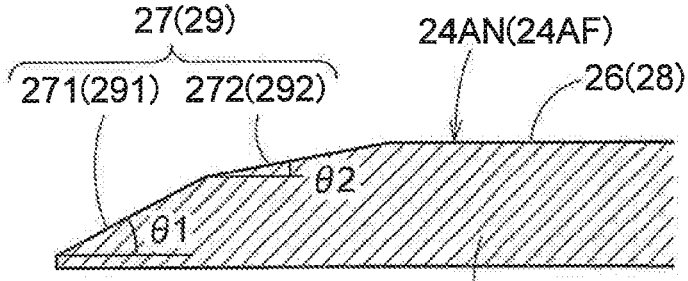
FIG. 7 is an enlarged view of FIG. 6.

FIG. 7 shows an enlarged view of FIG. 6, in more detail, a part in the vicinity of the inclined part 27 of the close-side first support surface 24AN. In this embodiment, the inclined part 27 includes a first inclined area 271 and a second inclined area 272 which have different inclination angles. The first inclined area 271 is formed on a distal end side of the inclined part 27, and the second inclined part 272 is formed closer to the flat part 26 than the first inclined area 271 so as to be connected to the flat part 26. As shown in FIG. 7, an angle θ1 defined by the first inclined area 271 with respect to the direction parallel to the flat part 26 is larger than an angle θ2 defined by the second inclined area 272 with respect to the direction parallel to the flat part 26.

The inclined part 29 of the open-side first support surface 24AF has the same inclined shape as that of the aforementioned inclined part 27. Thus, similarly thereto, the inclined part 29 includes a first inclined area 291 and a second inclined area 292 which have different inclination angles. The first inclined area 291 is formed on a side of a distal end side of the inclined part 29, and the second inclined part 292 is formed closer to the flat part 28 than the first inclined area 291 so as to be connected to the flat part 28. Similarly to the aforementioned inclined part 27, an angle defined by the first inclined area 291 with respect to the direction parallel to the flat part 28 is larger than an angle defined by the second inclined area 292 with respect to the direction parallel to the flat part 28. In FIG. 7, for the sake of explanation convenience, the reference numbers 291, 292 and so on are noted in brackets.

Figure 8:
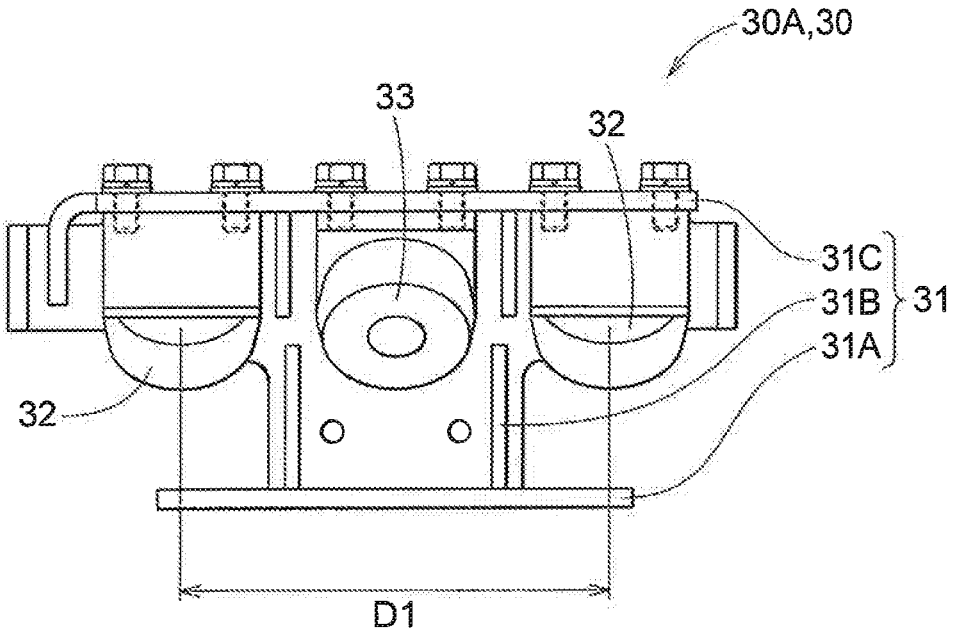
FIG. 8 is a view showing a first hanger of the sliding door apparatus shown in FIG. 1.
Figure 9:
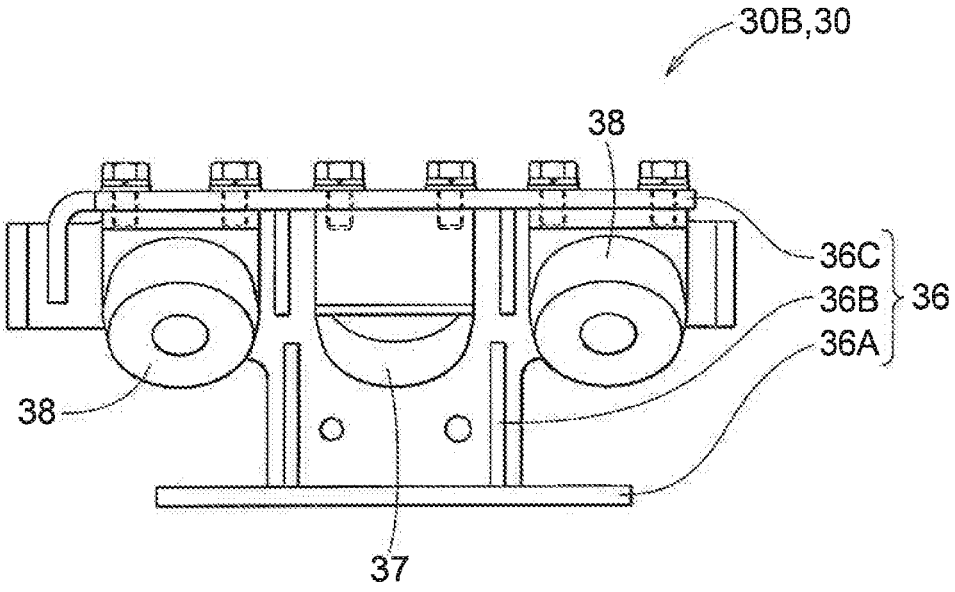
FIG. 9 is a view showing a second hanger of the sliding door apparatus shown in FIG. 1.

Next, the hanger 30 is described. As shown in FIG. 1, the hanger 30 has a first hanger 30A and a second hanger 30B which are located side by side from the side of the close-side rail part 20N to the side of the open-side rail part 20F. In more detail, the first hanger 30A is connected to one of ends of an upper surface of the door body 40 in the longitudinal direction of the rail 20, which one end is directed in the direction in which the door body 40 is moved toward the close position. The hanger 30B is connected to an end opposed to the end to which the first hanger 30A is connected to the door body 40. FIG. 8 shows the first hanger 30A, while FIG. 9 shows the second hanger 30B.

As shown in FIG. 3A and FIG. 8, the first hanger 30A includes a hanger body 31 having a lower plate 31A fastened on the upper surface of the door body 40 by a fastening member such as a bolt, a joint plate 31B extended upward from a front end of the lower plate 31A and an upper plate 31C extended rearward from an upper end of the joint plate 31B, as well as two first rollers 32 and a second roller 33 which are rotatably supported on the upper plate 31C.

The first roller 32 is a driving member in rolling contact with the first support surface 24A, and the second roller 33 is a driving member in rolling contact with the second support surface 24B. In the first hanger 30A, the one second roller 33 is located between the two first rollers 33. The first roller 32 and the second roller 33 have the same diametrical dimension. The first rollers 32 and the second roller 33 are rotatably supported on the upper plate 31C though brackets disposed on the upper plate 31C and shaft parts supposed by the brackets.

In addition, as shown in FIG. 3B, when seen along the longitudinal direction of the rail 20, rotation axis lines L1 of the two first rollers 32 are both orthogonal to a normal line N1 of the first support surface 24A (flat parts 26 and 28), and a rotation axis line L2 of the second roller 33 is orthogonal to a normal line N2 of the second support surface 24B. In addition, the two first rollers 32 and the second roller 33 are located to be offset from each other in the longitudinal direction of the rail 20. When seen along the longitudinal direction of the rail 20, the two second first rollers 32 and the one second roller 33 are partly overlapped with each other. In other words, in a projection projected in the longitudinal direction of the rail 20, the first rollers 32 and the second roller 33 are located so as to be partly overlapped with each other. In more detail, in this embodiment, in a plane of a projection projected in the longitudinal direction of the rail 20, each of the first rollers 32 is located to be overlapped with the second roller 33 such that the rotation axis line L1 is orthogonal to the rotation axis line L2 of the second roller 33 at a central point of the second roller 33 in the direction of the rotation axis line L2.

On the other hand, as shown in FIG. 9, the second hanger 30B includes a hangar body 36 having a lower plate 36A fastened on the upper surface of the door body 40 by a fastening member such as a bolt, a joint plate 36B extended upward from a front end of the lower plate 36A, and an upper plate 36C extended rearward from an upper end of the joint plate 36B, as well as two second rollers 38 and one first roller 37 which are rotatably supported on the upper plate 36C.

The first roller 37 is a driving member in rolling contact with the first support surface 24A, and the second roller 38 is a driving member in rolling contact with the second support surface 24B. In the second hanger 30B, the one first roller 37 is located between the two second rollers 38. The first roller and the second roller 38 have the same diametrical dimension, and have the same structure as those of the aforementioned first roller 32 and the second roller 33 of the first hanger 30A. Namely, the first roller 37 and the second roller 38 are also rotatably supported on the upper plate 36C through brackets disposed on the upper plate 36C and shaft parts supposed by the brackets.

Although illustration is omitted, similarly to the case of the first hanger 30A, in the second hanger 30B, when seen along the longitudinal direction of the rail 20, a rotation axis line of the first roller 37 is orthogonal to the normal line L1 of the first support surface 24A (flat parts 26 and 28), and a rotation axis line of the second roller 38 is orthogonal to the normal line N2 of the second support surface 24B. The two second rollers 38 and the first roller 37 are located to be offset from each other in the longitudinal direction of the rail 20. In a plane of a projection projected in the longitudinal direction of the rail 30, the two second rollers 38 and the one first roller 37 are located to be partly overlapped with each other. In more detail, similarly to the case of the aforementioned first hanger 30A, in a plane of a projection projected in the longitudinal direction of the rail 20, each of the second rollers 38 is located to be overlapped with the second roller 37 such that the rotation axis line of the second roller 38 is orthogonal to the rotation axis line of the first roller 37 at a central point of the first roller in the rotation axis line of the first roller.

In the aforementioned first hanger 30A, the first roller 32 rolls on the first support surface 24A, while the second roller 33 rolls on the second support surface 24B. In the second hanger 30B, the first roller 37 rolls on the first support surface 24A, while the second roller 38 rolls on the second support surface 24B. Thus, the first hanger 30A and the second hanger 30B are capable of moving in the longitudinal direction of the rail 20.

In the open position shown in FIG. 1, the first hanger 30A and the second hanger 30B are located on the open-side rail part 20F of the rail 20, with the first rollers 32 and 37 being supported on the flat part 28 of the first support surface 24A. When the first hanger 30A and the second hanger 30B are moved from this open position toward a side of the close-side rail part 20N (close position), at the same timing, the first hanger 30A is guided downward and toward the opening part 100 by the inclined part 27 of the close-side rail part 20N, and the second hanger 30B is guided downward and toward the opening part 100 by the inclined part 29 of the open-side rail part 20F. Thus, the door body 40 is moved downward and toward the opening part 100 immediately before the close position.

In FIG. 6 and FIG. 8, the reference number D1 depicts an inter driving member distance between the rotation axis lines L1 of the two first rollers 32 of the first hanger 30A. In addition, in FIG. 6, the reference number D2 depicts an inclined part distance between an inclination start point P1 at which the inclined part 29 of the open-side rail part 20F is inclined toward the opening part 100, and an end P2 of the close-side rail part 20N on the side adjacent to the open-side rail part 20F. In this embodiment, the inclined part distance D2 is not more than the inter driving member distance D1.

Thus, the first hanger 30A is capable of being moved to the flat part 26 of the close-side rail part 20N across the flat part 28 of the open-side rail part 20F, without being guided by the inclined part 29 downward and toward the opening part 100, and is also capable of being moved from the flat part 26 of the close-side rail part 20N to the flat part 28 of the open-side rail part 20F across the inclined part 29.

In FIG. 6, the two-dot chain lines depict the first rollers 32 and the roller 33 of the first hanger 30A immediately before they are guided by the inclined part 27, and the first roller 37 and the second rollers 38 of the second hanger 30B immediately before they are guided by the inclined part 29. As shown in FIG. 6, the first hanger 30A and the second hanger 30B are located such that, when one first roller 32 of the first rollers 32 of the first hanger 30A, which is located on the side of the second hanger 30B, is located at the inclination start point P3 of the inclined part 27 of the close-side rail part 20N toward the opening part 100, the first roller 37 of the second hanger 30B is located at the inclination start point P1 of the inclined part 29 of the open-side rail part 20F. Thus, the first hanger 30A and the second hanger 30B are guided, at the same timing, by the inclined parts 27 and 29 downward and toward the opening part 100.

Next, the door body 40 is described. As shown in FIG. 1 through FIG. 4, the door body 40 is hung on the rail 20 by the first hanger 30A and the second hanger 30B. The door body 40 has a rectangular shape larger than the opening part 100.

As shown in FIG. 3A and FIG. 4, a guide groove 41, which is concaved upward and is extended in the longitudinal direction of the rail 20 lengthwise, is formed in a lower surface of the door body 40, and a guide surface 42 which is extended in the longitudinal direction of the rail 20 lengthwise is formed on a lower end of a front surface of the door body 40. A first guide roller 43 protruding from a floor surface is inserted into the guide groove 41, and a second guide roller 44 protruding from the floor surface is near the guide surface 42. The first guide roller 43 and the second guide roller 44 are configured to be rotated about vertical rotation axis lines along the up and down direction.

As shown in FIG. 4, the guide groove 41 is equipped with a first cam member 45, and the guide surface 42 is equipped with a second cam member 46. At a timing when the first hanger 30A and the second hanger 3DB are started to be guided by the inclined parts 27 and 29 downward and toward the opening part 100, a slant surface of the first cam member 45 bears against the first guide roller 43. Similarly, at a timing when the first hanger 30A and the second hanger 30B are started to be guided by the inclined parts 27 and 29 downward and toward the opening part 100, a slant surface of the second cam member 46 bears against the second guide roller 44. Thus, the lower part of the door body 40 can be suitably moved downward and toward the opening part 100.

A seal member 47 made of an elastic material is provided on a rear part of the lower surface of the door body 40. With reference also to FIG. 1, a three-way seal member 48 is provided on the upper edge part 100U and both side edge parts of the opening part 100. As shown in FIG. 4, when the door body 40 has been moved downward and toward the opening part 100 immediately before the close position and then reaches the close position, the door body 40 and the opening part 100 are in tight contact with each other through the respective seal members 47 and 48. Thus, airtightness of the door body 40 in the close position can be improved.

Figure 10:
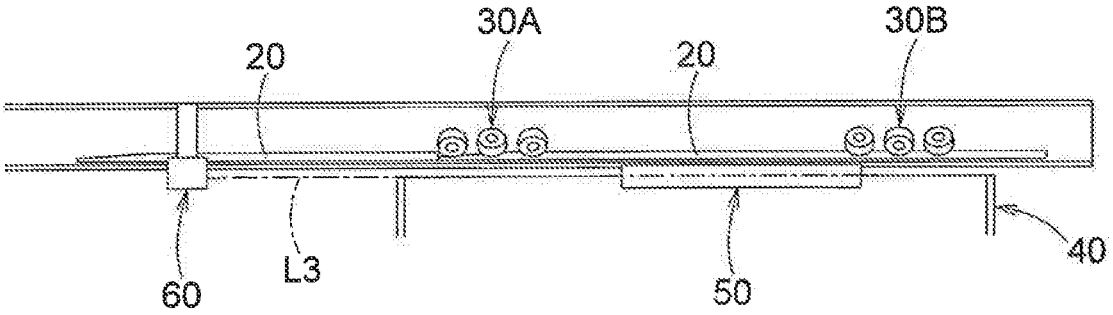
FIG. 10 is a view explaining how an operation assisting rod of the sliding door apparatus shown in FIG. 1 is mounted on a door body.
Figure 11:
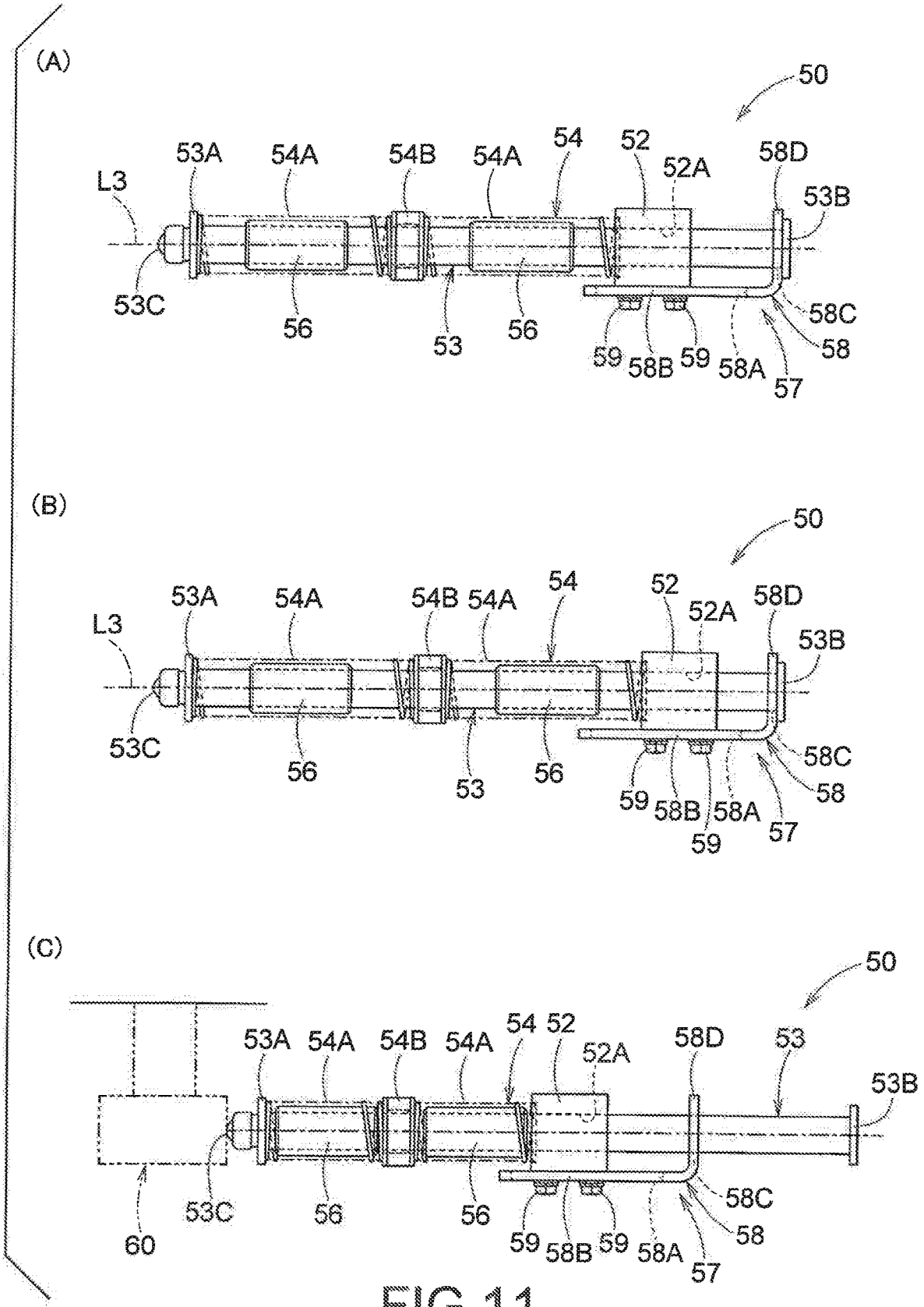
FIG. 11 is a view showing the operation assisting rod of the sliding door apparatus shown in FIG. 1.

Next, the operation assisting rod 50 is described. FIG. 10 shows a view explaining how the operation assisting rod 50 is mounted on the door body 40. FIG. 11 shows the operation assisting rod 50.

As shown in FIG. 10, the operation assisting rod 50 is fixed on the upper part of the door body 40 such that its axis line L3 is along the longitudinal direction of the rail 20. In a front view, the operation assisting rod 50 is located substantially centrally in the longitudinal direction of the upper part of the door body 40. FIG. 3A shows a bracket 51 for fixing the operation assisting rod 50 to the door body 40. The bracket 51 is fixed on the upper surface of the door body 40. The bracket 51 is extended frontward from the upper surface and is then extended upward. The operation assisting rod 50 is fixed on the upwardly extending portion of the bracket 51.

As shown in FIG. 11(A), the operation assisting rod 50 includes a fixed member 52 fixed on the door body 40 through the aforementioned bracket 51, a rod body 53 held by the fixed member 52 and movable in a direction parallel to the longitudinal direction of the rail 20, an elastic member 54 located between the fixed member 52 and the rod body 53, and an adjusting mechanism part 57 configured to hold relative positions of the fixed member 52 and the rod body 53 at given positions, with the elastic member 54 being elastically deformed.

The fixed member 52 has a through-hole 52A. The rod body 53 is slidably inserted to the through-hole 52A. The rod body 53 is provided with an annular first flange 53A at a distal end directed in the direction in which the door body 40 is moved toward the close position, i.e., at the distal end facing the receiving member 60, and is provided with an annular second flange 53B at an opposed end. A ball 53C is rotatably held on the distal end of the rod body 53. When the door body 40 is moved toward the close position, the ball 53C is configured to bear against the receiving member 60.

The elastic member 54 in this embodiment is located between the fixed member 52 and the first flange 53A of the rod body 53, and is configured to be elastically deformed (compressed) when the rod body 53 is pushed toward the fixed member 52. The elastic member 54 has two coil springs 54A located on an outer circumferential side of the rod body 53, and an annular connection member 54B which is configured to connect facing ends of the adjacent coil springs 54A, and is slidably supported on the rod body 53. In this embodiment, one of the ends of the two coil springs 54A, which ends are not connected by the connection member 54B, bears against the first flange 53A, and the other end bears against the fixed member 52.

In addition, in this embodiment, cylindrical bodies 56 slidably held on the rod body 53 are further located respectively between the two coil springs 54A and the rod body 53. The cylindrical body 56 is made of a resin material such as vinyl chloride. However, the material of the cylindrical body 56 is not specifically limited.

In addition, in this embodiment, the adjusting mechanism part 57 includes: a plate body 58 which has a first plate part 58B in which an elongate hole 58A extended along the rod body 53 is formed, and be located along the rod body 53, and a second plate part 58D which has a through-hole 58C through which the rod body 53 passes, and be extended from the first plate part 58B in a direction orthogonal to the rod body 53; and a bolt 59 passing through the elongate hole 58A of the first plate part 58B so as to fix the fixed member 52 to the first plate part 58B.

The second plate part 58D is located such that the rod body 53 passes through the through-hole 58C, with the second flange 53B being positioned outside the second plate part 58D. Since a circumferential edge part of the through-hole 58C of the second plate part 58D is axially opposed to the second flange 53B of the rod body 53, the second plate part 58D restricts movement of the rod body 53 in a projecting direction (toward the receiving member 60).

As shown in FIG. 11(B), by adjusting a position of the bolt 59 in the longitudinal direction of the elongate hole 58A to fix the fixed member 52 by means of the bolt 59, the adjustment mechanism part 55 can hold relative positions of the fixed member 52 and the rod body 53 at given positions, with the elastic member 54 being elastically deformed at a given deformation volume. Thus, an elastic force of the elastic member 54 can be optionally adjusted.

On the other hand, as shown in FIG. 10 and FIG. 11(C), the receiving member 60 is located on a line extended in a direction of the axis line L3 from the distal end of the rod body 53. During the movement of the operation assisting rod 50 caused by the movement of the door body 40 toward the close position, the receiving member 60 bears against the ball 53C of the distal end of the rod body 53. Thus, as shown in FIG. 11(C), the receiving member 60 is configured to elastically deform the elastic member 54 to push the rod body 53 toward the fixed member 52.

In this embodiment, when the first roller 32 (the first roller 32 on the side of the open position) of the first hanger 30A reaches the end of the flat part 26 of the first support surface 24A on the side of the inclined part 27, the distal end of the rod body 53 and the receiving member 60 bear against each other. Alternatively, the distal end of the rod body 53 and the receiving member 60 may bear against each other, when the first roller 32 (the first roller 32 on the side of the open position) of the first hanger 30A reaches the inclined part 27 of the first support surface 24A.

In addition, in this embodiment, the aforementioned elastic member 54 connects the two coil springs 54A in series. Thus, an elastic force of the elastic member 54 increases in proportion to an elastic deformation volume. In other words, as the door body 40 is moved toward the close position, the elastic force of the elastic member 54 increases. In this embodiment, as shown in FIG. 7, in the two inclined areas 271 and 272 and the two inclined areas 291 and 292 of the respective inclined parts 27 and 29, an inclination angle of an inclined area (271, 291), which is located on the side of the close position of the door body 40, is larger than an inclination angle of an inclined area (272, 292), which is located closer to the open position than those inclined area (271, 292). Namely, in these inclined areas, it means that an inclined area, in which the elastic member 54 has a larger elastic force when the roller (32, 33) or the roller (37, 38) reaches, is set to have a larger inclination angle.

Next, an operation of the sliding door apparatus 1 according to the this embodiment is described.

Figure 12:
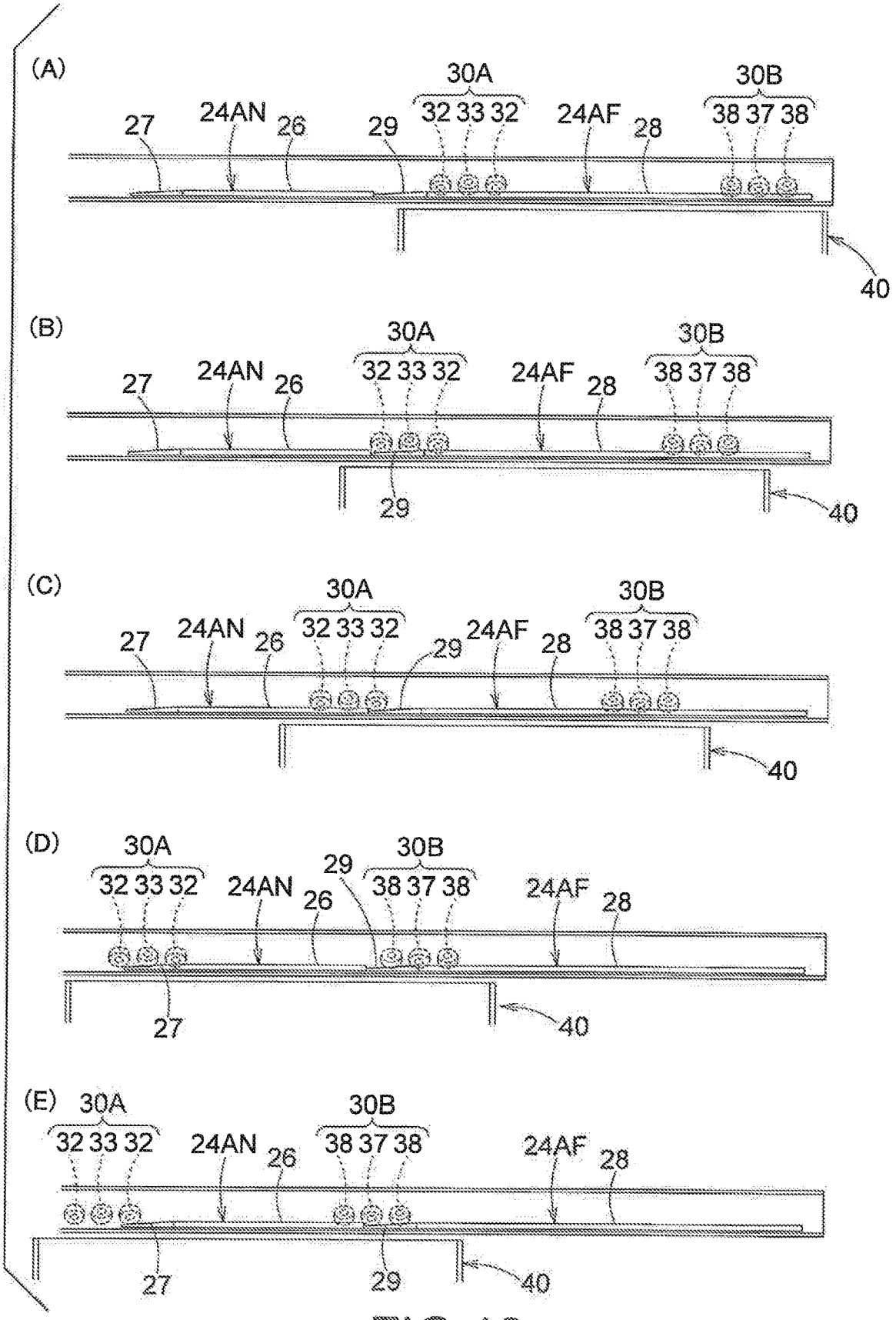
FIG. 12 is a view explaining an operation of the sliding door apparatus shown in FIG. 1.
Figure 13:
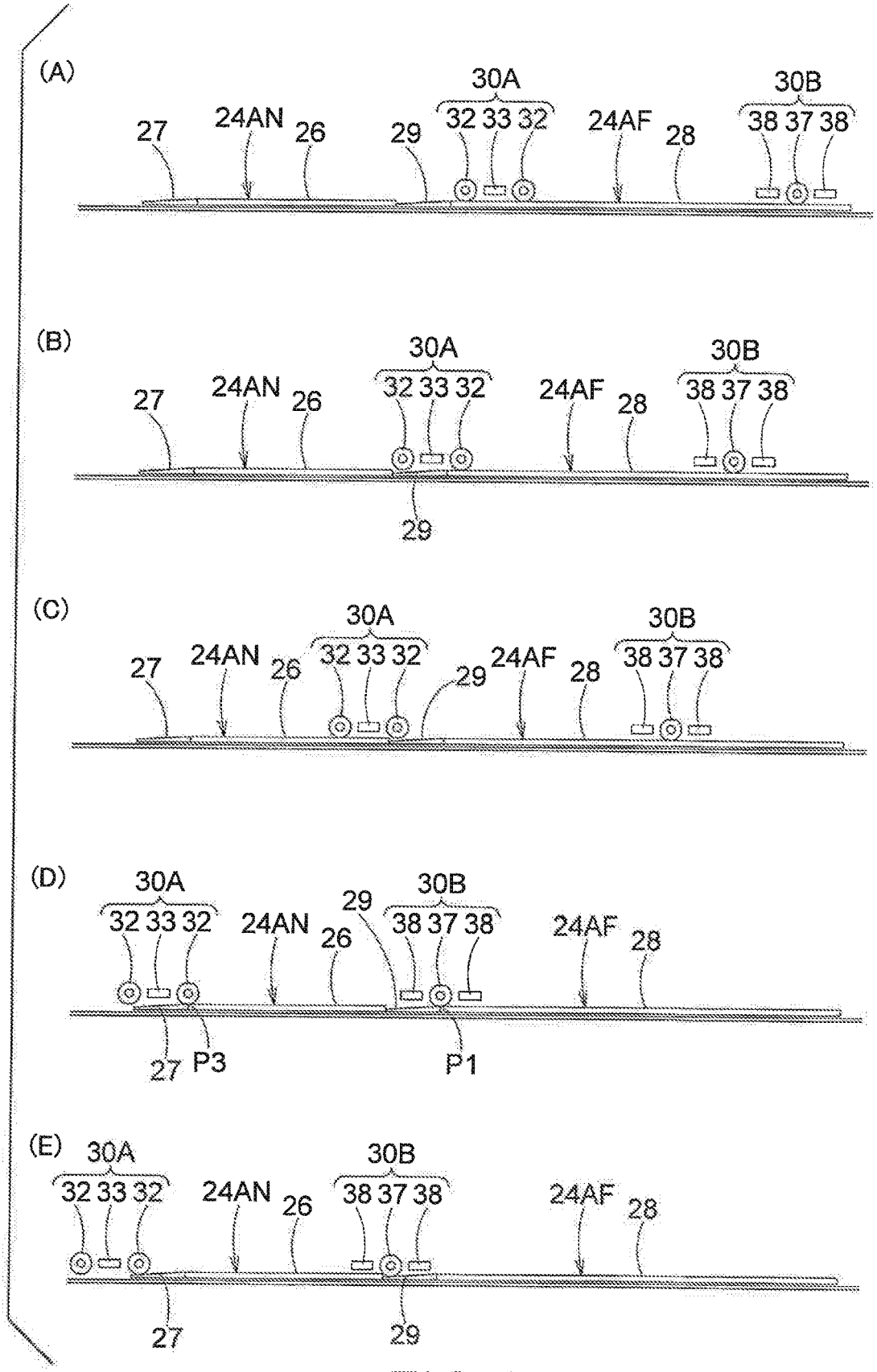
FIG. 13 is a view explaining an operation of the sliding door apparatus shown in FIG. 1.

FIG. 12 and FIG. 13 show views explaining an operation of the sliding door apparatus 1. FIGS. 12(A) to (E) are front views showing stepwise a state in which the first rollers 32 of the first hanger 30A and the first roller 37 of the second hanger 30B roll on the first support surface 24A from the open position up to the close position. FIGS. 13(A) to (E) are sectional views along the normal direction of the first support surface 24A, showing stepwise a state in which the first rollers 32 of the first hanger 30A and the first roller 37 of the second hanger 30B roll on the first support surface 24A.

In FIG. 1, FIG. 3A, FIG. 12(A) and FIG. 13(A), the sliding door apparatus 1 is in the open position (full-open position). In the open position, when the drive unit 80 drives to rotate the drive pulley 82 in one direction, the first hanger 30A and the second hanger 30B are moved toward the opening part 100, so that the door body 40 is moved toward the opening part 100.

Immediately after the movement toward the close position starts, the two first rollers 32 of the first hanger 30A roll on the flat part 28 of the open-side first support surface 24AF of the open-side rail part 20F, and the one second roller 33 of the first hanger 30A rolls on the open-side second support surface 24BF of the open-side rail part 20F. On the other hand, the one first roller 37 of the second hanger 30B rolls on the flat part 28 of the open-side first support surface 24AF of the open-side rail part 20F, and the two second rollers 38 of the second hanger 30B roll on the open-side second support surface 24BF of the open-side rail part 20F.

Thereafter, as shown in FIG. 12(B) and FIG. 13(B), when the first roller 32 of the two first rollers 32 of the first hanger 30A, which is located on the side of the close position (forward in the traveling direction), passes by the inclined part 29 of the open-side first support surface 24AF, the first roller 32 of the two first rollers 32, which is located on the side of the open position, and the first roller 37 of the second hanger 30B are supported on the flat part 28 of the open-side first support surface 24AF to roll thereon. Thus, as shown in FIG. 12(C) and FIG. 13(C), the first roller 32 located on the side of the close position can be transferred to the close-side first support surface 24AN of the close-side rail part 24N, without being guided by the inclined part 29.

Thereafter, when the first roller 32 located on the side of the open position has passed by the inclined part 29 of the open-side first support surface 24AF, the first roller 32 located on the side of the close position is supported on the flat part 26 of the close-side first support surface 24AN to roll thereon, and the first roller 37 of the second hanger 30B is supported on the flat part 28 of the open-side first support surface 24AF to roll thereon. Thus, the first roller 32 located on the side of the open position can be transferred to the close-side first support surface 24AN of the close-side rail part 24N, without being guided by the inclined part 29.

Thereafter, as shown in FIG. 12(D) and FIG. 13(D), when the first roller 32 located on the side of the open position is located at the inclination start point P3 of the inclined part 27 of the close-side first support surface 24AN, the first roller 37 of the second hanger 30B is located at the inclination start point P1 of the inclined part 29 of the open-side rail part 20F. Thus, as shown in FIGS. 12(E) and 13(E), at the same timing, the first hanger 30A is guided by the inclined part 27 downward and toward the opening part 100, and the second hanger 30B is guided by the inclined part 29 downward and toward the opening part 100.

Thus, the door body 40 is moved downward and toward the opening part 100 immediately before the close position. After that, as shown in FIG. 4, the door body 40 reaches the close position. At this time, the door body 40 and the opening part 100 are in tight contact with each other through the respective seal embers 47 and 48. As a result, airtightness of the door body 40 in the close position is improved. When the door body 40 is moved downward and toward the opening part 100, the second roller 33 of the first hanger 30A and the second rollers 38 of the second hanger 30B slide along the second support surface 24B downward and toward the opening part 100.

In addition, in this embodiment, when the first roller 32 (the first roller 32 on the side of the open position) of the first hanger 30A reaches the end of the flat part 26 of the first support surface 24A on the side of the inclined part 27 (FIG. 12(D) and FIG. 13 (D)), the distal end of the rod body 53 of the operation assisting rod 50 and the receiving member 60 bear against each other. Thus, as the door body 40 is moved toward the close position after the operation assisting rod 50 and the receiving member 60 have born against each other, as shown in FIG. 11(C), the rod body 53 of the operation assisting rod 50 is pushed toward the fixed member 52 so that the elastic member 54 is compressed and deformed. Since the elastic member 54 is subjected to a self weight of the door body 40 caused by the downward movement of the door body 40, the elastic member 54 is compressed and deformed by a strong force. Thus, in the close position of the door body 40, an elastic force for assisting an operation for opening the door body 40 is accumulated in the operation assisting rod 50.

The elastic force accumulated in the operation assisting rod 50 contributes restraint in output of the drive unit 80 when the door body 40 is moved from the close position to the open position. In addition, the elastic force can assist a manual operation for opening the door body 40, if the drive unit 80 cannot be driven because of interruption of electric service, for example.

In this embodiment, since the elastic member 54 connects the two coil springs 54A in series, an elastic force of the elastic member 54 increases in proportion to an elastic deformation volume. In the two inclined areas 271 and 272 and the two inclined areas 291 and 292 of the respective inclined parts 27 and 29, an inclination angle of an inclined area (271, 291), which is located on the side of the close position of the door body 40, is larger than an inclination angle of an inclined area (272, 292), which is located closer to the open position than those inclined area (271, 292). Namely, in these inclined areas, an inclined area, in which the elastic member 54 has a larger elastic force when the roller (32, 33) or the roller (37, 38) reaches, is set to have a larger inclination angle.

Thus, the inclined area (271, 291), which can ensure relatively a larger elastic force acting on the door body 40, is set to have relatively a larger inclination angle. Therefore, when the door body 40 is moved on the inclined area (271, 291) toward the open position, the movement of the door body 40 is assisted by a large elastic force, although a larger resistance comes from the door body 40. On the other hand, the inclined area (272, 292), which cannot ensure relatively a larger elastic force acting on the door body 40, is set to have relatively a smaller inclination angle. Therefore, when the door body 40 is moved toward the open position on the inclined area (272, 292), a resistance from the door body 40 becomes smaller, although the elastic force is small. Thus, non-uniform resistance occurring in the door body 40 is restrained. As a result, the door body 40 can be smoothly opened.

When the door body 40 is moved from the close position to the open position, the drive unit 80 drives to rotate the drive pulley 82 in the other direction opposite to the one direction, so that the first hanger 30A and the second hanger 30B are moved from the close position shown in FIG. 2, FIG. 12(E) and FIG. 13(E) away from the opening part 100, whereby the door body 40 is moved toward the opening part 100.

Immediately after the movement toward the open position, the first roller 32 of the two first rollers 32 of the first hanger 30A, which is located on the side of the open position, rolls on the inclined part 27, and the one second roller 33 of the first hanger 30A rolls on the close-side second support surface 24BN. On the other hand, the one first roller 37 of the second hanger 30B rolls on the inclined part 29, and the two second rollers 38 of the second hanger 30B rolls on the open-side second support surface 24BF of the open-side rail part 20F. At this time, the elastic force accumulated in the operation assisting rod 50 assists the movement of the door body 40.

Thereafter, as shown in FIG. 12(D) and FIG. 13(D), the first roller 32 of the first hanger 30A, which is located on the side of the open position, passes by the inclined part 27 to ride on the flat part 26. In addition, the first roller 37 of the second hanger 30B passes by the inclined part 29 to ride on the flat part 28. Thus the door body 40 is moved by the inclined parts 27 and 29 upward and away from the opening part 100.

Thereafter, as shown in FIG. 12(*c*) and FIG. 13(C), when the first roller 32 located on the side of the open position has passed by the end of the close-side first support surface 24AN, the first roller 32 located on the side of the close position is supported on the flat part 26 of the close-side first support surface 24AN to roll thereon, and the first roller 37 of the second hanger 30B is supported on the flat part 28 of the open-side first support surface 24AF to roll thereon. Thus, as shown in FIG. 12(B) and FIG. 13(B), the first roller 32 located on the side of the close position can be transferred to the open-side first support surface 24AF of the open-side rail part 24F, without being guided by the inclined part 29.

Thereafter, when the first roller 32 located on the side of the close position has passed by the end of the close-side first support surface 24AN, the first roller 32 located on the side of the open position is supported on the flat part 28 of the open-side first support surface 24AF to roll thereon, and the first roller 37 of the second hanger 30B is supported on the flat part 28 of the open-side first support surface 24AF to roll thereon. Thus, as shown in FIG. 12(A) and FIG. 13(A), the first roller 32 located on the side of the close position can be transferred to the close-side first support surface 24AN of the open-side rail part 24F, without being guided by the inclined part 29.

As to the first hanger 30A, the two first rollers 32 are supported on the flat part 28 of the open-side first support surface 24AF, and the one second roller 33 is supported on the open-side second support surface 24BF. On the other hand, as to the second hanger 30B, the one first roller 37 is supported on the flat part 28 of the open-side first support surface 24AF, and the two second rollers 38 are supported on the open-side second support surface 24BF. Thus, the door body 40 is in the open position.

The sliding door apparatus 1 as described above is provided with the rail 20 having the inner surface 24 formed to have a concave shape, the inner surface 24 having the first support surface 24A and the second support surface 24B not parallel to each other, the hangers 30A and 30B each having the first roller(s) (32, 37) rolling in contact with the first support surface 24A and the second roller(s) (33, 38) rolling in contact with the second support surface 24B, and the door body 40 that is moved in the longitudinal direction of the rail 20 through the hangers 30A and 30B. When seen along the longitudinal direction of the rail 20, the first support surface 24A and the second support surface 24B are formed to come closer to each other, as they extend toward the bottom of the inner surface 24.

According to such a structure, when the door body 40 is swung about an axis line parallel to the longitudinal direction of the rail 20, the first roller (32, 37) and the second roller (33, 38) receive from the corresponding support surfaces 24A and 24B reaction forces acting in a direction in which the swinging movement is restrained. In addition, the concaved inner surface 24 of the rail surrounds first roller (32, 37) and the second rollers (33, 38) such that their movement outside the rail 20 (such as derailing) is restricted. Thus, the support state of the first roller (32, 37) and the second roller (33, 38) by the rail 20 is made stable. Thus, the door body 40 is smoothly moved, while the swinging movement of the door body 40 is effectively restrained. Moreover, since the first roller (32, 37) and the second roller (33, 38) can roll separately from each other on the corresponding support surfaces 24A and 24B, uneven abrasion of the first roller (32, 37) and the second roller (33, 38) can be prevented.

In this embodiment, the door body 40 is moved by the inclined part (27, 29) of the rail 20 toward the opening part 100. Due to this structure, when the first roller (32, 37) moves on the inclined part (27, 29), the first roller cannot constantly receive from the inclined part (27, 29) a reaction force acting in the direction in which the swinging movement is restrained, whereby the door body 40 is likely to swing. Particularly in this case, in the sliding door apparatus 1 according to this embodiment, since the support stated of the first roller (32, 37) and the second roller (33, 38) by the rail 20 can be made stable by the concaved inner surface 24, the swinging movement of the door body 40 can be effectively restrained. In addition, even when the door body 40 is moved by the inclined part (27, 29) of the rail 20 toward the opening part 100, since the first roller (32, 37) and the second roller (33, 38) can roll separately from each other on the corresponding support surfaces 24A and 24B, uneven abrasion of the first roller (32, 37) and the second roller (33, 38) can be prevented.

In addition, the aforementioned inclined part (27, 29) has the first inclined area (271, 279) and the second inclined area (272, 292) which have inclination angles different from each other.

Thus, when the first roller (32, 37) is moved on the inclined part (27, 29), it is possible to vary resistances from the door body 40 between the first inclined area (271, 291) and the second inclined area (272, 292). Thus, an operation feeling of the door body 40 can be suitably varied.

In addition, in this embodiment, the rail 20 has the close-side rail part 20N and the open-side rail part 20F. The inclined part 27 is formed on the close-side rail part 20N, while the inclined part 29 is formed on the open-side rail part 20F. The first hanger 30A has the two first rollers 32 and the one second roller 33, with the second roller 33 being located between the two first rollers 32. The second hanger 30B has the two second rollers 38 and the one first roller 37, with the first roller 37 being located between the two second rollers 38. When the door body 40 is moved from the close-side rail part 20N toward the open-side rail part 20F, the first roller 32 of the first hanger 30A can be transferred to the open-side rail part 20F across the inclined part 29 of the open-side rail part 20F, without being guided by the inclined part 29 of the open-side rail part 20F toward the opening part 100. Thus, the door body 40 can be moved away from the opening part 100 as soon as possible without any trouble in movement, whereby a non-pulled part of the door body 40 can be prevented.

In addition, as described above, in the structure in which the first hanger 30 has the two first rollers 32 and the one second roller 33 and the second hanger 30B has the two second rollers 38 and the one first roller 37, when the door body 40 is likely to be rotated about an axis line orthogonal to the longitudinal direction of the rail 20, which is the axis line passing through between the first support surface 24A and the second support surface 24B when seen along the longitudinal direction of the rail 20, the rollers located on the end sides of the respective hangers 30A and 30B prevent the rotation. Thus, operability of the connecting operation between the door body 40 and the hanger 30A, 30B can be improved.

In addition, when seen along the longitudinal direction of the rail 20, the rotation axis line L1 of the first roller (32, 37) is orthogonal to the normal line N1 of the first support surface 24A, the rotation axis line L2 of the second roller (33, 38) is orthogonal to the normal line N2 of the second support surface 24B, and the first roller (32, 37) and the second roller (33, 38) are located to be offset from each other in the longitudinal direction of the rail 20 and are partially overlapped with each other in a plane of a projection projected in the longitudinal direction of the rail 20.

Thus, the dimensions of the first roller (32, 37) and the second roller (33, 38) in the depth direction (back and forth direction) and in the vertical direction (up and down direction) can be effectively restrained. Thus, for example, the door apparatus can be made smaller as a whole. In addition, for example, when a door body having a large weight is used so that the first roller (32, 37) and the second roller (33, 38) have to be made larger, the dimensions of the first roller (32, 37) and the second roller (33, 38) in the depth direction and in the vertical direction can be restrained. Thus, even when the upper case 10, which accommodates the first roller (32, 37), the second roller (33, 83) and the drive unit 80 above the opening part 100 that is opened and closed by the door body 40, has restriction in design or in size, the enlarged first roller (32, 37) and the enlarged second roller (33, 38) can be highly possibly accommodated in the case 10. Thus, it can be avoided that the door apparatus cannot be installed because of the enlargement of the first rollers (32, 37) and the second rollers (33, 38).

In addition, the sliding door apparatus 1 according to the above-described embodiment includes: the rail 20 which is located to extend along the upper edge part 100U of the opening part 100, and has the support surface 24A having the flat parts 26 and 28 and the inclined parts 27 and 29 inclined from the flat parts 26 and 28 toward the opening part 100; the hangers 30A and 30B having the first rollers 32, 37 in rolling contact with the support surface 24A of the rail 20; and the door body 40 that is moved in the longitudinal direction of the rail 20 through the hangers 30A and 30B. Further, the sliding door apparatus 1 includes: the operation assisting rod 50 having the fixed member 52 fixed on the door body 40, the rod body 53 held on the fixed member 52 and movable in a direction parallel to the longitudinal direction of the rail 20, and the elastic member 54 located between the fixed member 52 and the rod body 53; and the receiving member 60 located on the line extended in the direction of the axis line L3 from the distal end of the rod body 53, the receiving member 60 being configured to bear against the distal end of the rod body 53 to elastically deform the elastic member 54 during the movement of the operation assisting rod 50 caused by the movement of the door body 40 toward the close position, so as to push the rod body 53 toward the fixed member 52. When the door body 40 is being moved toward the close position, the door body 40 is moved from the flat parts 26 and 28 of the support surface 24A toward the inclined parts 27 and 29. When the first roller 32, 37 of the hanger 30A, 30B reaches the end of the flat part 26, 28 of the support surface 24A on the side of the inclined part 27, 29, the distal end of the rod body 53 and the receiving member 60 are configured to bear against each other. The inclined part 27, 29 has the inclined area 271, 291 and the inclined area 272, 292 which have different inclination angles.

According to this, when the door body 40 in the close position is opened, the resistance from the door body 40 can be adjusted by the inclined areas 271 and 291 and the inclined areas 272 and 292 of different inclination angels, while making use of the elastic force of the elastic member 54. Thus, by adjusting the elastic force for each of the inclined areas 271 and 291 and each of the inclined areas 272 and 292, the door body 40 in the close position can be smoothly lifted to open by a small force, and the tight contact condition between the packing (the outer circumferential edge part of the opening part, the three-way seal member 48 in this embodiment) and the door body 48 can be promptly released.

To be specific, in this embodiment, in the inclined areas 271 and 291 and the inclined areas 272 and 292, an inclined area, in which the elastic member 54 has a larger elastic force when the roller 32, 33 reaches, is set to have a larger inclination angle. To be more specific, the elastic force of the elastic member 54 increases in proportion to an elastic deformation volume. In the inclined areas 271 and 272 and the inclined areas 291 and 292 of the respective inclined parts 27 and 29, an inclination angle of the inclined area 271, 291, which is located on the side of the close position of the door body 40, is larger than an inclination angle of the inclined area 272, 292, which is located closer to the open position than those inclined area 271, 292.

Thus, the inclined area 271, 291, which can ensure relatively a larger elastic force acting on the door body 40, is set to have relatively a larger inclination angle. Therefore, when the door body 40 is moved on the inclined area 271, 291 toward the open position, the movement of the door body 40 is assisted by a large elastic force, although a larger resistance from the door body 40 is produced. On the other hand, the inclined area 272, 292, which cannot ensure relatively a larger elastic force acting on the door body 40, is set to have relatively a smaller inclination angle. Therefore, when the door body 40 is moved toward the open position on the inclined area (272, 292), a resistance from the door body 40 becomes smaller, although the elastic force is small. Thus, non-uniform resistance is restrained from occurring in the door body 40. As a result, the door body 40 can be smoothly opened.

In this embodiment, the inclination angle θ1 of the first inclined area 271, 291, which is located on the side of the close position of the door body 40, is larger than the inclination angle θ2 of the second inclined area 272, 292, which is located on the side of the open position of the door body 40. Instead thereof, the inclination angle θ1 of the first inclined area 271, 291 may be smaller than the inclination angle θ2 of the second inclined area 272, 292. In this case, when the door body 40 is moved toward the open position on the first inclined area 271, 291, a resistance from the door body 40 becomes smaller and the movement toward the open side is assisted by a large elastic force. Thus, the tight contact condition of the packing, i.e., the three-way seal member 48 and the door body 40 can be promptly released.

In addition, the operation assisting rod 50 has the adjusting mechanism part 57 configured to hold relative positions between the fixed member 52 and the rod body 53 at given positions, with the elastic member 54 being elastically deformed.

Thus, by holding the relative positions of the fixed member 52 and the rod body 53 at given positions by the adjusting mechanism part 57 with the elastic member 54 being elastically deformed, the elastic force of the elastic member 54 before the rod body 53 and the receiving member 60 bear against each other can be adjusted. Thus, for example, when the door body 40 is exchanged to a door body having a different weight, the elastic force of the elastic member 54 can be adjusted depending on the difference in weight. Thus, difference in feeling of the operation for opening the door body before and after the weigh varies can be restrained. As a result, after the weight has varied, the door body 40 can be smoothly opened.

In addition, the elastic member 54 has a plurality of the coil springs 54A located on the outer circumferential side of the rod body 53, and the connection member 54B which is configured to connect facing ends of the adjacent coil springs 54A, and is slidably supported on the rod body 53. Thus, a deflection amount of each coil spring 54A is restrained. It can be restrained that the coil springs 54A and the rod body 53 come into contact to each other to generate noises.

In addition, between the coil springs 54A and the rod body 53, there are disposed the cylindrical bodies 56 slidably supported on the rod body 53. Thus, the cylindrical body 56 restrains the deflection of the coil spring 54A, and prevents the contact between the coil spring 54A and the rod body 53 whereby generation of noises can be effectively restrained.

The ball 53C is rotatably held on the distal end of the rod body 53, and the ball 53C is configured to bear against the receiving member 60. Thus, when the first rollers 32 and 37 roll on the inclined parts 27 and 29 so that the door body 40 is moved toward the opening part 100, the distal end of the rod body 53 rolls on the receiving member 60 through the ball 53C. Thus, sliding resistance between the distal end of the rod body 53 and the receiving member 60 can be restrained.

Although the one embodiment of the present invention has been described above, the present invention is not limited to the aforementioned embodiment. For example, in the above-described embodiment, the first rollers 32 and the second roller 33 as driving members are rotatably supported on the first hanger 30A, the first rollers 32 are in rolling contact with the first support surface 24A, and the second roller 33 is in rolling contact with the second support surface 24B. In addition, the first roller 37 and the second rollers 38 as driving members are rotatably supported on the second hanger 30B, the first roller 37 is in rolling contact with the first support surface 24A, and the second rollers 38 are in rolling contact with the second support surface 24B. However, instead thereof, the first support surface 24A and the second support surface 24B may be equipped with rollers. For example, block-like driving members disposed on the first hanger 30A and the second hanger 30B then may be moved in rolling contact with the rollers of the first support surface 24A and the second support surface 24B.

Figure 14:
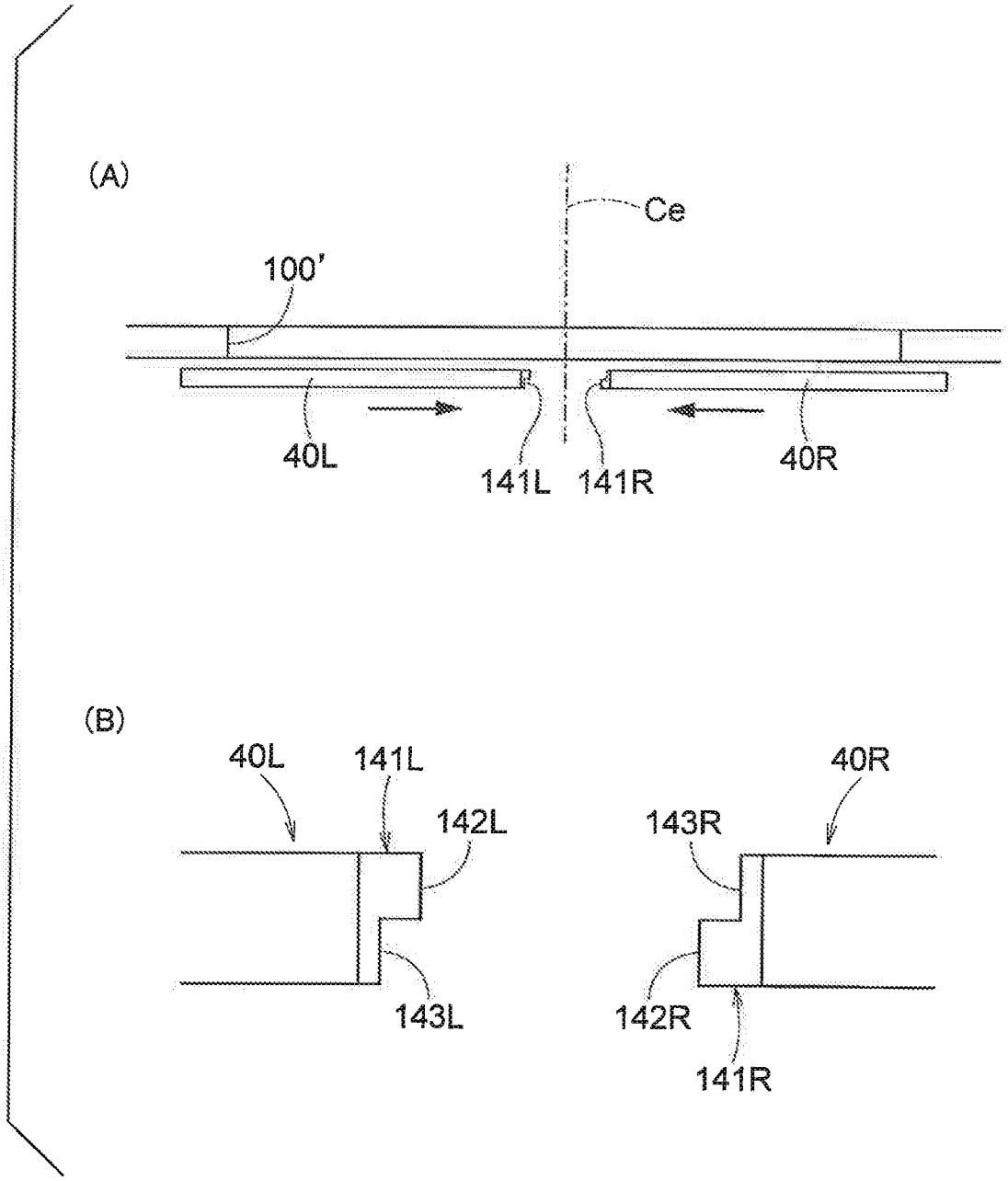
FIG. 14 is a view explaining a modification example of the aforementioned embodiment.

In addition, in the above embodiment, the present invention is applied to a single sliding door apparatus. However, as a modification example, the present invention can be applied to a double sliding door apparatus as shown in FIG. 14. FIG. 14(A) is a schematic view of the sliding door apparatus according to the modification example when seen from above. In this example, a door body 40L and a door body 40R are moved in directions shown by the arrows. When ends (door ends) of the respective door bodies 40L and 46R bear against each other in a center Ce of an opening part 100', the opening part 100' is closed. In such a structure, inclined parts 27 and 29 are formed on a rail 20, not shown in FIG. 14, symmetrically with reference to the center Ce. An operation assisting rod 50 may be provided on each of the door bodies 40L and 40R.

FIG. 14(B) is an enlarged view of the respective door ends of the doors 40L and 40R of FIG. 14(A). In this example, a rubber member 141L is disposed on the door end of the door 40L. A rubber member 141R is disposed on the door end of the door body 40R. The rubber member 141L disposed on the door end of the door 40L has a protrusion 142L projecting toward the door body 40R and a recess 143L concaved with respect to the protrusion 142L. In addition, the rubber member 141R disposed on the door 40R has a protrusion 142R projecting toward the door body 40L and a recess 143R concaved with respect to the protrusion 142R. In a direction in which the door bodies 40L and 40R are located side by side, the protrusion 142L and the recess 143R face each other, and the protrusion 141R and the recess 143L face each other. In such a structure, when the door ends of the door body 40L and the door body 40R bear against each other, the rubber member 141L and the rubber member 141R are meshed with each other. Thus, the airtightness can be improved. In this example, although a side surface of the protrusion 142L projects at right angle with respect to the recess 143L, the side surface may project inclinedly. The same applies to the protrusion 142R. When the side surfaces of the protrusions 142L and 142R are inclined, the airtightness can be suitably maintained. However, as in the example shown in FIG. 14, as long as the airtightness can be maintained, the side surfaces of the protrusions 142L and 142R may project at right angle with respect to the recesses 143L and 143R.

1 Sliding door apparatus
20 Rail
20N Close-side rail part
20F Open-side rail part
24 Inner surface
24A First support surface
24AN Close-side first support surface
24AF Open-side first support surface
24B Second support surface
24BN Close-side second support surface
24BF Open-side second support surface
26 Flat part
27 Inclined part

271 First inclined area
272 Second inclined area
28 Flat part
29 Inclined part
291 First inclined area
292 Second inclined area
30 Hanger
30A First hanger
30B Second hanger
32 First roller
33 Second roller
37 First roller
38 Second roller
40 Door body
50 Operation assisting rod
51 Bracket
52 Fixed member
53 Rod body
53A First flange
53B Second flange
53C Ball
54 Elastic member
54A Coil spring
55 Connection member
56 Cylindrical body
57 Adjusting mechanism part
58 Plate body
58A Elongate hole
58B First plate part
58C Through-hole
58D Second plate part
59 Bolt
60 Receiving member
100 Opening part
100U Upper edge part
L1 Rotation axis line of first roller
L2 Rotation axis line of second roller
L3 Axis line of operation assisting rod
N1 Normal line of first support surface
N2 Normal line of second support surface
D1 Inter driving member distance
D2 Inclined part distance
P1 Inclination start point
P3 Inclination start point

What is claimed is:

1. A sliding door apparatus comprising:

a rail having an inner surface formed to have a concave shape, the inner surface having a first support surface and a second support surface which are not parallel to each other;

a hanger having a first driving member in rolling contact with the first support surface, and a second driving member in rolling contact with the second support surface; and a door body configured to be moved in a longitudinal direction of the rail through the hanger;

wherein when seen along the longitudinal direction of the rail, the first support surface and the second support surface are formed to come close to each other as they extend toward a bottom of the inner surface;

the rail is located to extend along an outer circumferential edge part of an opening part that is opened and closed by the door body;

when seen along the longitudinal direction of the rail, the first support surface is located closer to the opening part than the second support surface;

the first support surface includes a flat part, and an inclined part inclined from the flat part toward the opening part;

the first driving member and the second driving member are rollers;

a rotation axis line of the first driving member is orthogonal to a rotation axis line of the second driving member at a central point of the second driving member in a direction of the rotation axis line of the second driving member, in plane of projection projected in the longitudinal direction of the rail; and the first driving member and the second driving member are located to be overlapped with each other, in said projected plane.

2. The sliding door apparatus according to claim 1, wherein the inclined part has a first inclined area and a second inclined area, which have inclination angles different from each other.

3. The sliding door apparatus according to claim 1, wherein:

the rail has a close-side rail part located on the side of the outer circumferential edge part of the opening part, and an open-side rail part located at a position farther from the outer circumferential edge part of the opening part than the close-side rail part;

the flat part and the inclined part are formed on each of the first support surface in the close-side rail part and the first support surface in the open-side rail part;

the hanger has a first hanger and a second hanger located side by side from the side of the close-side rail part to the side of the open-side rail part;

the first hanger has two of the first driving members and one second driving member located between the two first driving members;

the second hanger has two of the second driving members and one first driving member located between the two second driving members; and a distance between an inclination start point of the inclined part of the open-side rail part and an end of the close-side rail part on the side adjacent to the open-side rail part is not more than a distance between the two first driving members in the first hanger.

4. The sliding door apparatus according to claim 1, wherein the first driving member and the second driving member are located to be offset from each other in the longitudinal direction of the rail.

5. The sliding door apparatus according to claim 4, wherein the first driving member and the second driving member are located to be partially overlapped with each other, in a projected plane wherein the first driving member and the second driving member are projected in the longitudinal direction of the rail.

6. The sliding door apparatus according to claim 1, wherein:

when seen along the longitudinal direction of the rail, a rotation axis of the first driving member is orthogonal to a normal line of the first support surface, and a rotation axis line of the second driving member is orthogonal to a normal line of the second support surface; and the first driving member and the second driving member are located to be offset from each other in the longitudinal direction of the rail, and are partly overlapped with each other in a projected plane wherein the first driving member and the second driving member are projected in the longitudinal direction of the rail.

7. The sliding door apparatus according to claim 1, wherein the hanger comprises one of:

two of the first driving members and one second driving member, with the second driving member being located between the two first driving members, or two of the second driving members and one first driving member, with the first driving member being located between the two second driving members.

8. The sliding door apparatus according to claim 1, further comprising:

an operation assisting rod including a fixed member fixed on the door body, a rod body held by the fixed member and movable in a direction parallel to the longitudinal direction of the rail, and an elastic member located between the fixed member and the rod body;

a receiving member located on a line extended in a direction of an axis line from a distal end of the rod body, the receiving member being configured to bear against the distal end of the rod body and to elastically deform the elastic member to push the rod body toward the fixed member, during a movement of the operation assisting rod caused by a movement of the door body toward a close position;

wherein:

when the door body is moved toward the close position, the door body is moved from the flat part of the first support surface toward the inclined part;

when the first driving member of the hanger reaches an end of the flat part of the first support surface on the side of the inclined part, or reaches the inclined part of the first support surface, the distal end of the rod body and the receiving member are configured to bear against each other; and the inclined part has a plurality of inclined areas of different inclination angles.

9. The sliding door apparatus according to claim 8, wherein an elastic force of the elastic member is adjusted for each of the inclined areas, such that the elastic force acting in a first inclined area is larger than the elastic force acting in a second inclined area when the first inclined area has a larger inclination angle than the second inclined area.

10. The sliding door apparatus according to claim 9, wherein:

the elastic force of the elastic member increases in proportion to an elastic deformation volume; and in the plurality of inclined areas, an inclination angle of an inclined area located on the side of the close position of the door body is larger than an inclination angle of an inclined area located closer to the open position of the door body.

11. The sliding door apparatus according to claim 8, wherein the operation assisting rod has an adjusting mechanism part configured to hold relative positions between the fixed member and the rod body at given positions, with the elastic member being elastically deformed.

12. The sliding door apparatus according to claim 8, wherein the elastic member includes a plurality of coil springs located on a side of an outer peripheral of the rod body, and a connection member configured to connect facing ends of the adjacent coil springs, the connection member being slidably supported on the rod body.

13. The sliding door apparatus according to claim 12, wherein a cylindrical body slidably supported on the rod body is located between one of the plurality of coil springs and the rod body.

14. The sliding door apparatus according to claim 8, wherein a ball is rotatably held on the distal end of the rod body, the ball being configured to bear against the receiving member.

* * * * *